US008916028B2

(12) United States Patent
Ota et al.

(10) Patent No.: US 8,916,028 B2
(45) Date of Patent: Dec. 23, 2014

(54) PROCESSING MACHINE AND PAPER SHEET PROCESSING DEVICE

(71) Applicant: Duplo Seiko Corporation, Kinokawa-shi (JP)

(72) Inventors: Satoshi Ota, Kinokawa (JP); Tomoyuki Nagayama, Kinokawa (JP); Masasuke Funase, Kinokawa (JP)

(73) Assignee: Duplo Seiko Corporation, Kinokawa-Shi, Wakayama (JP)

( * ) Notice: Subject to any disclaimer, the term of this patent is extended or adjusted under 35 U.S.C. 154(b) by 0 days.

(21) Appl. No.: 14/150,900

(22) Filed: Jan. 9, 2014

(65) Prior Publication Data

US 2014/0196861 A1 Jul. 17, 2014

(30) Foreign Application Priority Data

Jan. 11, 2013 (JP) ..... 2013-003996
Aug. 30, 2013 (JP) ..... 2013-179601

(51) Int. Cl.
*B26D 1/00* (2006.01)

(52) U.S. Cl.
USPC ..... 162/286; 83/404; 83/405; 83/406; 83/407; 270/37; 270/52.17; 270/58.07

(58) Field of Classification Search
USPC ..... 162/286; 271/264, 248, 278; 83/404–408
See application file for complete search history.

(56) References Cited

U.S. PATENT DOCUMENTS

2006/0145415 A1 7/2006 Oota et al.
2008/0258379 A1 10/2008 Oota et al.

FOREIGN PATENT DOCUMENTS

GB 2475715 A 6/2011
JP 4298544 B2 7/2009

OTHER PUBLICATIONS

Extended European Search Report issued May 13, 2014, by the European Patent Office in corresponding European Patent Application No. 14150240.1 (4 pages).

*Primary Examiner* — Mark Halpern
(74) *Attorney, Agent, or Firm* — Buchanan Ingersoll & Rooney PC

(57) ABSTRACT

In a processing machine including a processor having a processing blade and a receiver having a reception member and in which a blade edge of the processing blade and a reception portion, of the reception member, engage with each other to process a paper sheet therebetween, the processing blade is one processing blade selected from a blade group and is attached to the processor so as to be changeable to another processing blade of the blade group, reception portions of kinds corresponding to a plurality of kinds of the processing blades of the blade group are formed on the reception member, and the processing blade attached to the processor is positioned so as to be in a position where the blade edge is engageable with the reception portion of the corresponding kind.

22 Claims, 31 Drawing Sheets

PROCESSING MACHINE AND PAPER SHEET PROCESSING DEVICE

BACKGROUND OF THE INVENTION

1. Technical Field

The present invention relates to a processing machine that processes paper sheets, and a paper sheet processing device having the processing machine.

2. Background Art

A paper sheet processing device that performs different kinds of processings on paper sheets while conveying the paper sheets is shown, for example, in Patent Document 1 (Japanese Patent No. 4,298,544). In this device, a plurality of processing units are provided so as to be detachably attachable to the device body, and as the processing units, processing units each performing a different kind of processing are used. The different kinds of processings mean processings including both (a) a case where the forms are different and (b) a case where the sizes and/or configurations are different although the forms are the same. Examples of the case (a) include perforation processing and folding processing. Examples of the case (b) include, in the case of the folding processing, a case where the width of the formed folding pattern is different and/or a case where the configuration of the formed folding pattern is different.

SUMMARY OF THE INVENTION

Problems to be Solved by the Invention

The device of Patent Document 1 where one processing unit performs one kind of processing has the following problems:

(1) To perform a multiplicity of kinds of processings, it is necessary to prepare a multiplicity of processing units. Therefore, a large storage space for the processing units is required, and this increases cost.

(2) When it is intended to change the kind of processing, it is necessary to change the processing unit itself. Therefore, the work is extensive and burdensome.

An object of the present invention is to provide a processing machine capable of solving the above-mentioned problems and a paper sheet processing device having the processing machines.

Means for Solving the Problems

A processing machine according to a first aspect of the present invention is a processing machine comprising a processor having a processing blade and a receiver having a reception member and in which a blade edge of the processing blade and a reception portion, of the reception member, of a kind corresponding to a kind of the processing blade engage with each other to thereby process a paper, sheet situated therebetween, and in the processing machine, the processing blade is one processing blade arbitrarily selected from a blade group consisting of at least two different kinds of processing blades and is attached to the processor so as to be changeable to another processing blade of the blade group, reception portions of kinds corresponding to all the kinds of the processing blades of the blade group are formed on the reception member, and the processing blade is positioned so as to be in a position where the blade edge is engageable with the reception portion of the corresponding kind only by being attached to the processor.

Preferably, the processing machine according to the first aspect of the present invention arbitrarily adopts the following structures:

(a) The processing blade is screwed to the processor.

(b) The processing blade is a rotary blade.

(c) In the above (b), the processing blade has a boss portion, and is positioned by a thickness of the boss portion that is set according to the kind of the processing blade.

(d) The processing blade is a guillotine blade.

(e) In the above (d), the processing blade and the reception member are interchangeable with each other.

(f) The blade group consists of at least two arbitrary ones of a cutting blade, a perforating blade, a creasing blade, a half-cutting blade and a micro-perforating blade.

(g) The number of kinds of the reception portion formed on the reception member is smaller than the number of kinds of the processing blades of the blade group.

A paper sheet processing device according to a second aspect of the present invention is a paper sheet processing device having the above-described processing machine and processing a paper sheet while conveying the paper sheet, a conveyance mechanism that conveys the paper sheet and a width direction movement mechanism that moves the processing machine in a direction orthogonal to a conveyance direction of the paper sheet are provided, the processing blade is a rotary blade that performs processing along the conveyance direction of the paper sheet, a setting portion for setting processing information of the paper sheet and inputting the kind of the processing blade attached to the processing machine and a controller that controls an operation of the processing machine based on the set processing information are provided, and the controller has a movement adjuster that adjusts, based on the inputted kind of the processing blade, the width direction movement mechanism so that a position of the blade edge of the processing blade coincides with a processing position of the paper sheet in the set processing information.

A paper sheet processing device according to a third aspect of the present invention is a paper sheet processing device having the above-described processing machine and processing a paper sheet while conveying the paper sheet, a conveyance mechanism that conveys the paper sheet is provided, the processing blade is a rotary blade or a guillotine blade that performs processing along a direction orthogonal to a conveyance direction of the paper sheet, a setting portion for setting processing information of the paper sheet and inputting the kind of the processing blade attached to the processing machine and a controller that controls an operation of the processing machine based on the set processing information are provided, and the controller has a conveyance adjuster that adjusts, based on the inputted kind of the processing blade, the conveyance mechanism so that a processing position of the paper sheet in the set processing information coincides with a position of the blade edge of the processing blade.

A paper sheet processing device according to a fourth aspect of the present invention is a paper sheet processing device having the above-described processing machine and processing a paper sheet while conveying the paper sheet, a conveyance mechanism that conveys the paper sheet and a width direction movement mechanism that moves the processing machine in a direction orthogonal to a conveyance direction of the paper sheet are provided, the processing blade is a rotary blade that performs processing along the conveyance direction of the paper sheet, the processing blade each has identification information for indicating its kind, a setting portion for setting processing information of the paper sheet, controller that controls an operation of the processing machine based on the set processing information and a reader that reads the identification information of the processing blade attached to the processing machine are provided, and the controller has a kind detector that detects the kind of the processing blade based on the identification information read by the reader and a movement adjuster that adjusts, based on the detected kind of the processing blade, the width direction movement mechanism so that a position of the blade edge of the processing blade coincides with a processing position of the paper sheet in the set processing information.

A paper sheet processing device according to a fifth aspect of the present invention is a paper sheet processing device having the above-described processing machine and processing a paper sheet while conveying the paper sheet, a conveyance mechanism that conveys the paper sheet is provided, the processing blade is a rotary blade or a guillotine blade that performs processing along a direction orthogonal to a conveyance direction of the paper sheet, the processing blade each has identification information for indicating its kind, a setting portion for setting processing information of the paper sheet, a controller that controls an operation of the processing machine based on the set processing information and a reader that reads the identification information of the processing blade attached to the processing machine are provided, and the controller has a kind detector that detects the kind of the processing blade based on the identification information read by the reader and a conveyance adjuster that adjusts, based on the detected kind of the processing blade, the conveyance mechanism so that a processing position of the paper sheet in the set processing information coincides with a position of the blade edge of the processing blade.

Preferably, the paper sheet processing device according to the fourth or fifth aspect of the present invention arbitrarily adopts the following structures:

(h) The controller further has a stopper that compares the detected kind of the processing blade and the kind of the processing blade required for executing the set processing information with each other and when the kinds do not coincide with each other, stops initiation of operation of the processing machine.

(i) A display portion that displays the detected kind of the processing blade is further provided.

(j) The identification information of the processing blade is a disposition pattern of a plurality of through holes formed in the processing blade, and the reader has a sensor that detects the disposition pattern of the through holes.

(k) A guide member that guides the paper sheet to the processing machines is provided so as to be detachably attachable to the processing machines.

Effects of the Invention

With the processing machine according to the first aspect of the present invention, the kind of the processing at the processing machine can be easily changed.

With the paper sheet processing device according to the second, third, fourth or fifth aspect of the present invention, the kind of the processing can be easily changed and easily confirmed.

DETAILED DESCRIPTION OF THE INVENTION

First Embodiment

A paper sheet processing device having a processing machine of a first embodiment of the present invention will be described.

[General Structure]

Figure 1:
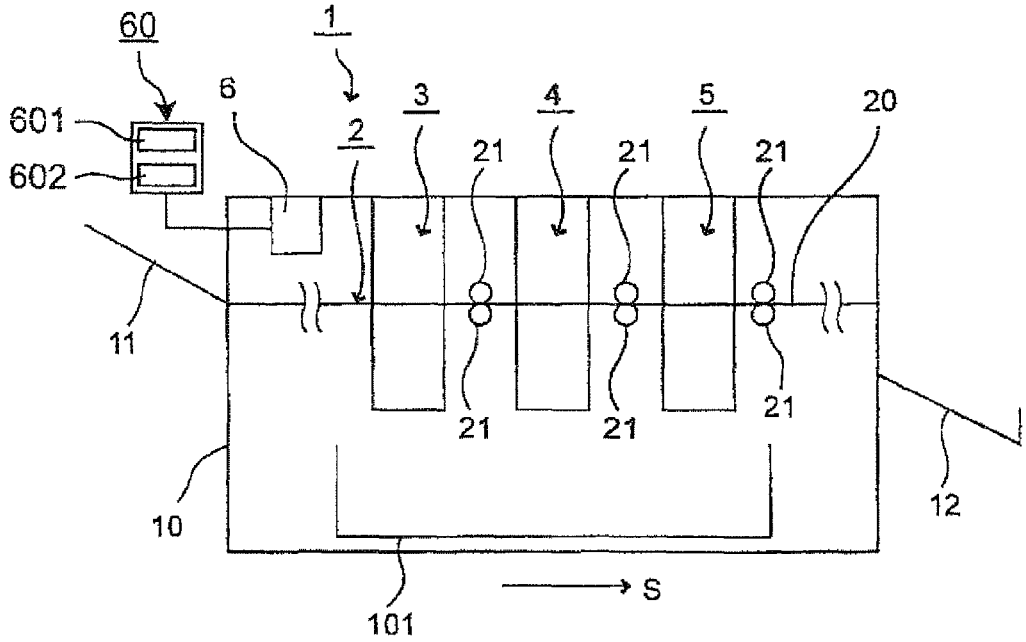
FIG. 1 is a schematic cross-sectional view of a paper sheet processing device having a processing machine of a first embodiment of the present invention.

FIG. 1 is a schematic cross-sectional view of the paper sheet processing device having the processing machine of the present embodiment. The paper sheet processing device 1 has, at both ends of a device body 10, a paper feed portion 11 having a paper feed tray and a paper ejection portion 12 having a paper ejection tray. From the paper feed portion 11 to the paper ejection portion 12, a conveyance path 20 is formed by a conveyance mechanism 2 including a number of pairs of rollers 21. The conveyance mechanism 2 conveys paper sheets from the paper feed portion 11 toward the paper ejection portion 12 in the direction of the arrow S. In the conveyance direction indicated by the arrow S, the side of the paper feed portion 11 will be referred to as "upstream side" and the side of the paper ejection portion 12 will be referred to as "downstream side". On the conveyance path 20, from the side of the paper feed portion 11, by way of a conveyance correction portion, an information reading portion, a rejection portion and the like (not shown), a first processing device unit 3, a second processing device unit 4, a third processing device unit 5 and the like are provided. These are all supported by the device body 10.

The number of processing device units depends on the number of processings, and is not limited to three. Moreover, the processing device unit has one or more, preferably, two processing machines. The processing machine includes a processor having a processing blade and a receiver having a reception member, and the blade edge of the processing blade and the reception portion, of the reception member, of the kind corresponding to the kind of the processing blade engage with each other to thereby process the paper sheet situated therebetween.

Moreover, the paper sheet processing device 1 has, in the device body 10, a controller 6 that controls the overall operation of the device. The controller 6 has a CPU connected to an operation panel 60. Further, the paper sheet processing device 1 has, at the bottom in the device body 10, a trash box 101 for accommodating paper chips caused by the paper sheet processing.

[Conveyance Mechanism]

The conveyance mechanism 2 is coupled to a driver (not shown) of the conveyance mechanism.

[Operation Panel]

The operation panel 60 has a setting portion 601 and a display portion 602. The operator can set, with the setting portion 601, processing information of the paper sheet, that is, the contents of the processing including the kind and position of the processing on the paper sheet. The display portion 602 is capable of displaying the kind of the processing blade attached to the processing machine.

[Processing Device Unit]

Figure 2:
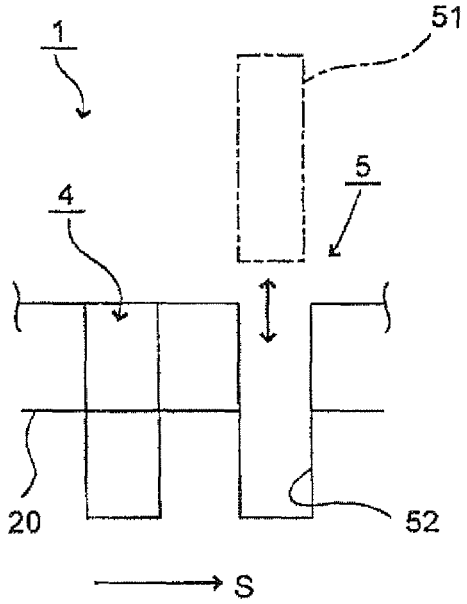
FIG. 2 is a schematic view showing the part of a third processing device unit in the paper sheet processing device of FIG. 1.

The third processing device unit 5 will be described. FIG. 2 shows the part of the third processing device unit 5 in the paper sheet processing device 1. The third processing device unit 5 includes a processing unit 51 and an acceptance portion 52 to which the processing unit 51 is detachably attached. The acceptance portion 52 has a driver (described later) that drives the processing unit 51 and part of a unit detector. The acceptance portion 52 is formed on the device body 10.

(Processing Unit)

Figure 3:
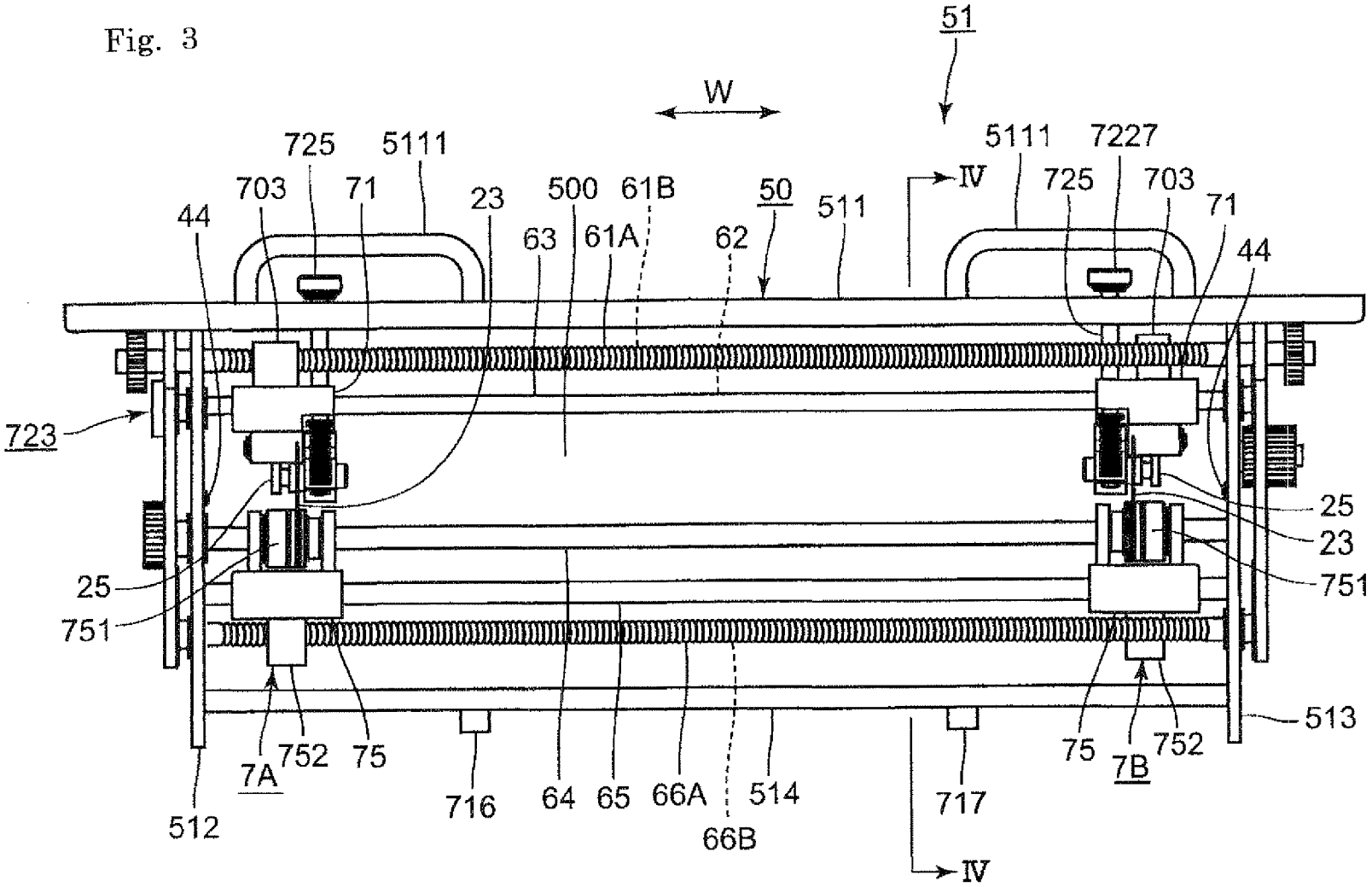
FIG. 3 is a front view of a processing unit viewed from the upstream side.

FIG. 3 is a front view of the processing unit 51 viewed from the upstream side.

In the processing unit 51, an outer frame member 50 is formed by a top plate 511, a left side plate 512 and a right side plate 513 hanging down from the sides of the top plate 511, and a bottom frame 514 coupling the lower end portions of the side plates 512 and 513. On the upper face of the top plate 511, two handles 5111 are provided that are grasped when the processing unit 51 is attached to and detached from the acceptance portion 52.

The processing unit 51 includes two processing machines 7A and 7B in an internal space 500 of the outer frame member 50. The processing unit 51 further includes a rotation mechanism for rotating the processing blades of the processing machines, a width direction movement mechanism for independently moving the processing machines in a width direction W which is a direction orthogonal to the conveyance direction, an approaching and separating direction movement mechanism for moving the processing blades of the processing machines in an approaching and separating direction with respect to the reception member, part of the unit detector that detects the kind of the processing unit, and a reader that reads the identification information of the processing blades of the processing machines. In the third processing device unit 5, the processing blades can assume a close condition and a separated condition with respect to the reception member by the approaching and separating direction movement mechanism. In the present embodiment, the approaching and separating direction is the vertical direction.

(a) Processing Machines

Figure 4:
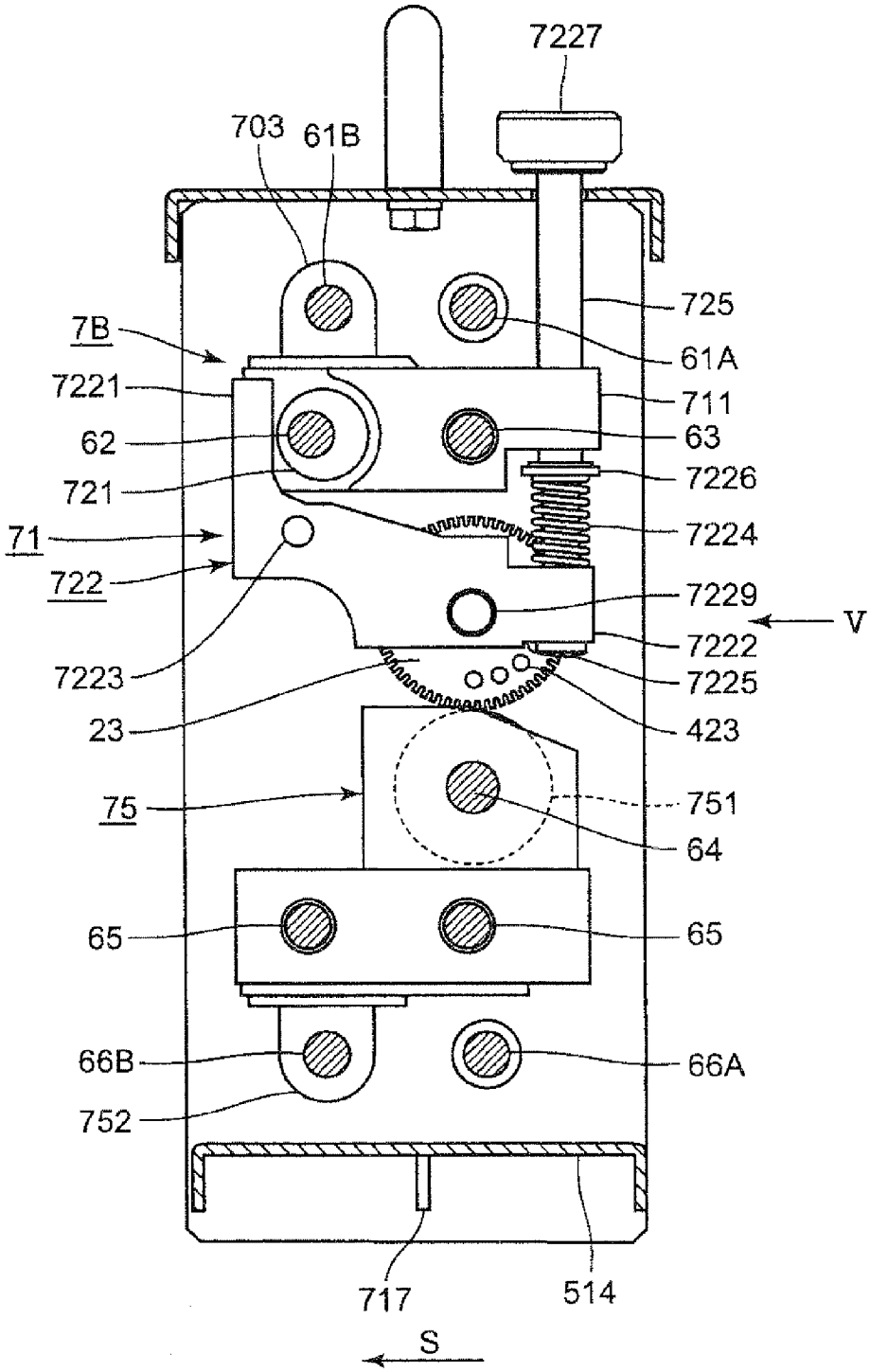
FIG. 4 is a cross-sectional view taken in the direction of arrows IV-IV of FIG. 3 and is a side view of one of the processing machines.
Figure 5:
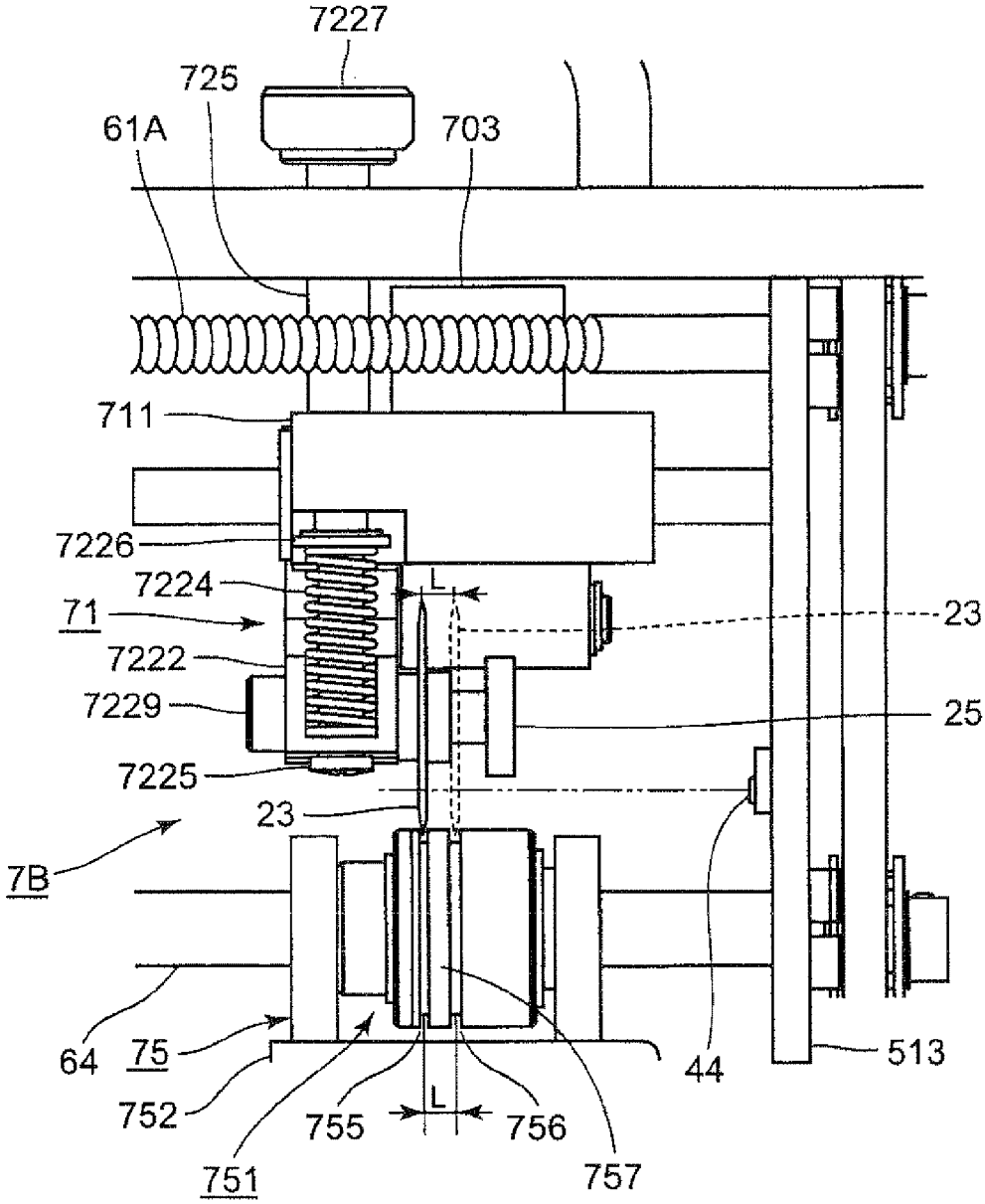
FIG. 5 is a view in the direction of an arrow V of FIG. 4.
Figure 6:
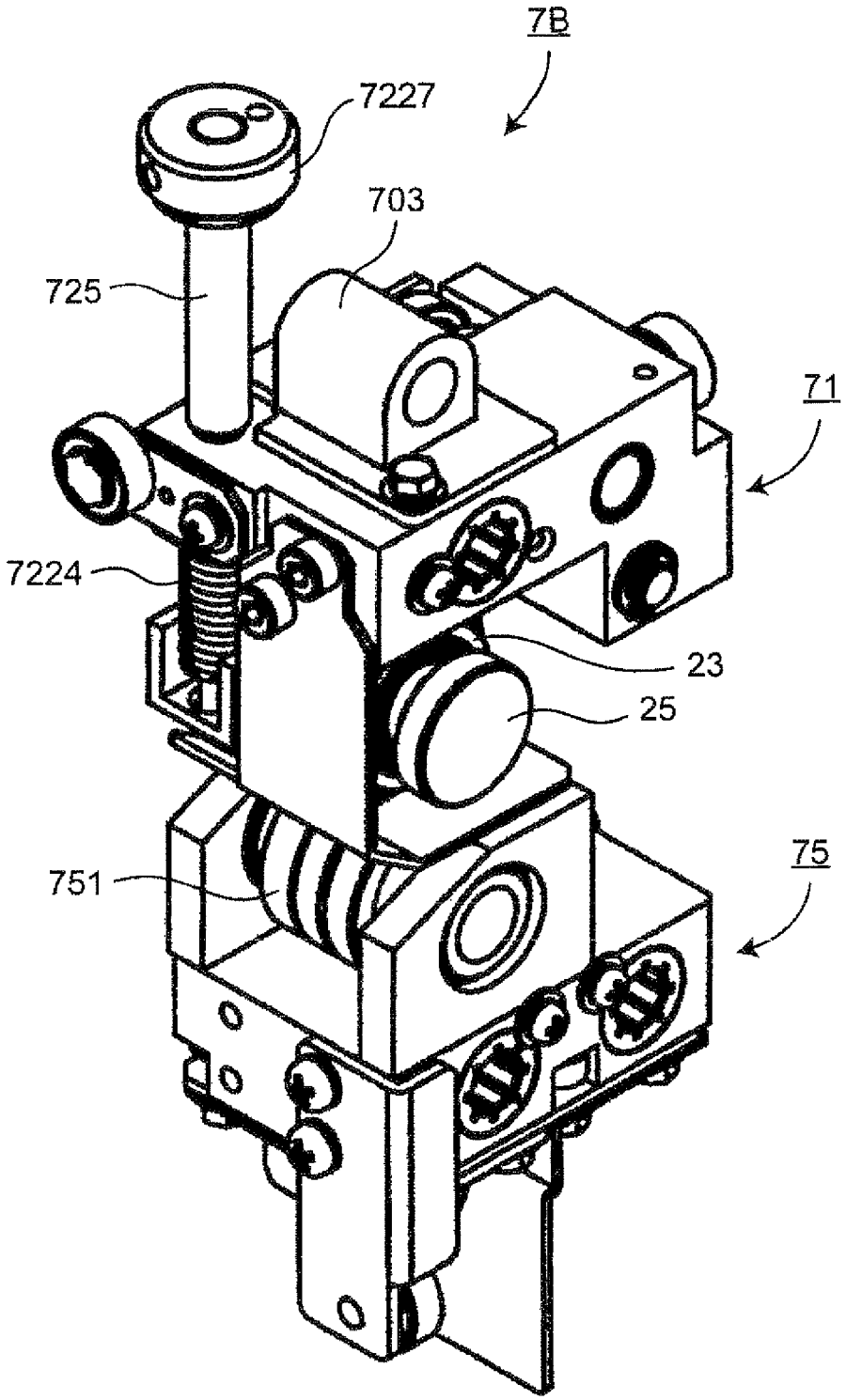
FIG. 6 is a perspective view of one of the processing machines.

The processing machines 7A and 7B are the processing machines of the present embodiment. FIG. 4 is a cross-sectional view taken in the direction of arrows IV-IV of FIG. 3, and is a side view of the processing machine 7B. FIG. 5 is a view in the direction of an arrow V of FIG. 4. FIG. 6 is a perspective view of the processing machine 7B. The structure of the processing machine 7B and the structure of the processing machine 7A are reverse to each other.

The processing machine 7B includes a processor 71 having a processing blade 23 and a receiver 75 having a reception member 751. In the present embodiment, the processing blade 23 is one kind of processing blade arbitrarily selected from a blade group consisting of a perforating blade, a creasing blade, a half-cutting blade and a micro-perforating blade, and is a perforating blade in FIGS. 4 to 6.

Figure 7:
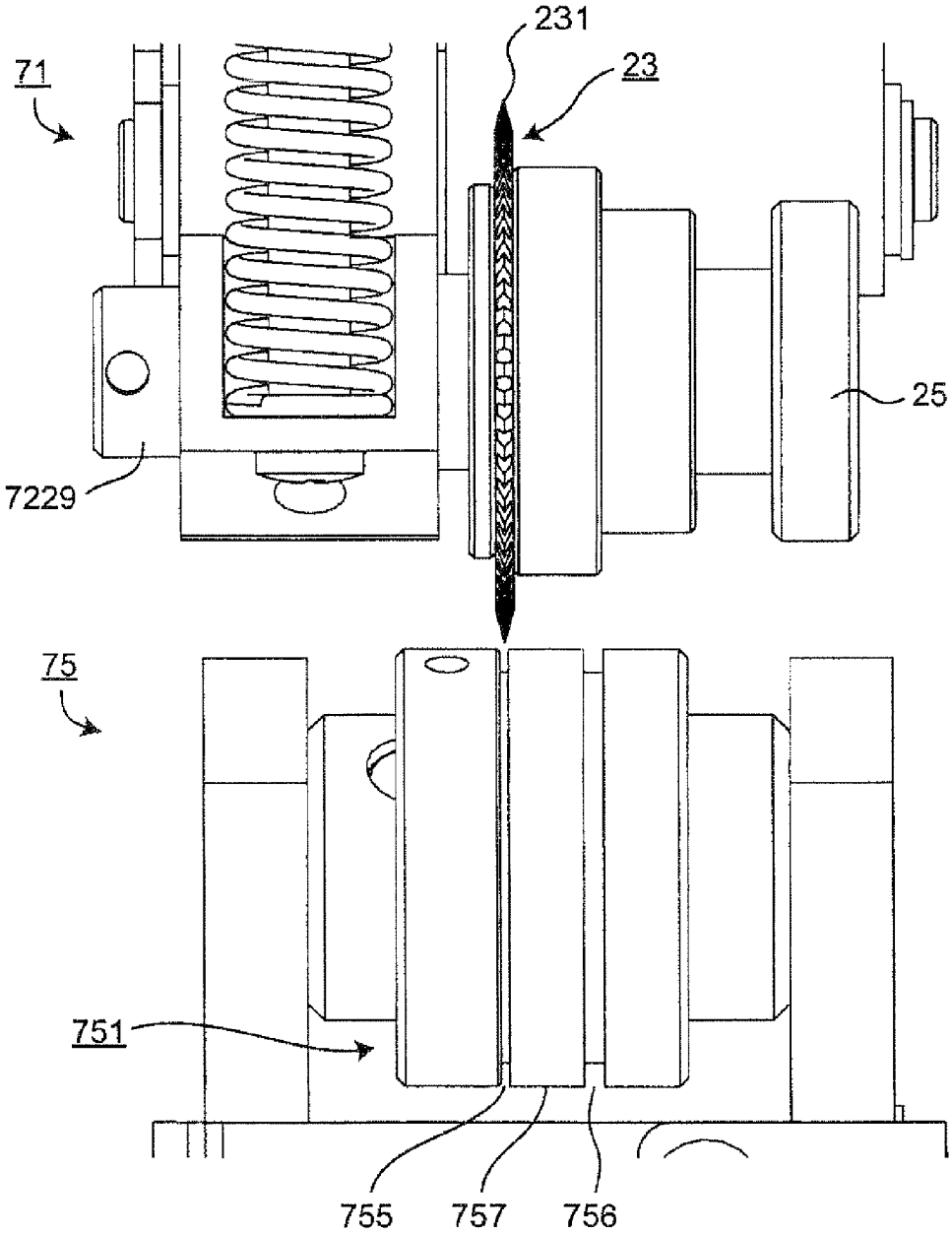
FIG. 7 is an enlarged view of a relevant part of FIG. 5 and shows a case where a perforating blade is attached as the processing blade.
Figure 8:
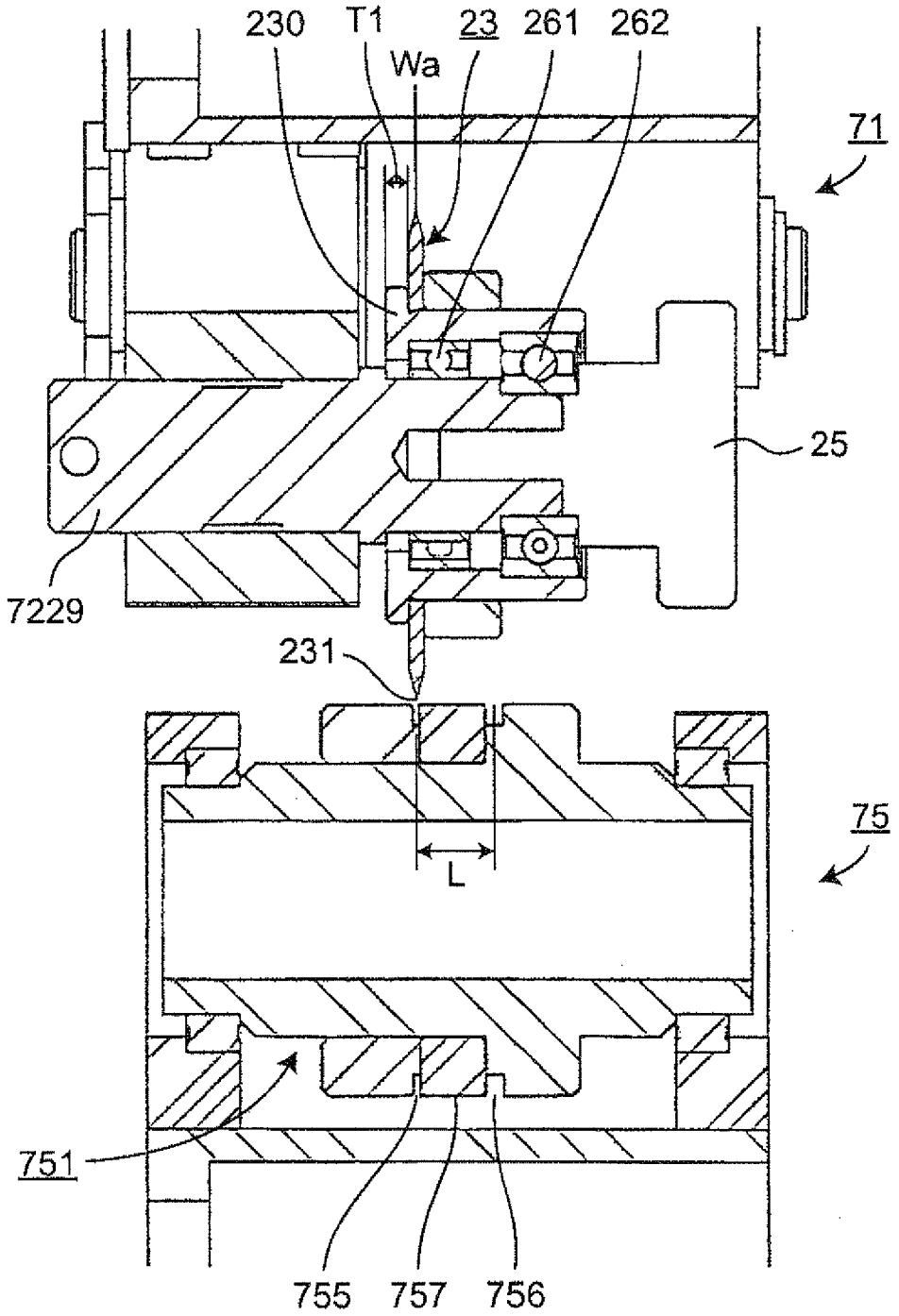
FIG. 8 is a longitudinal cross-sectional view of the relevant part shown in FIG. 7.
Figure 9:
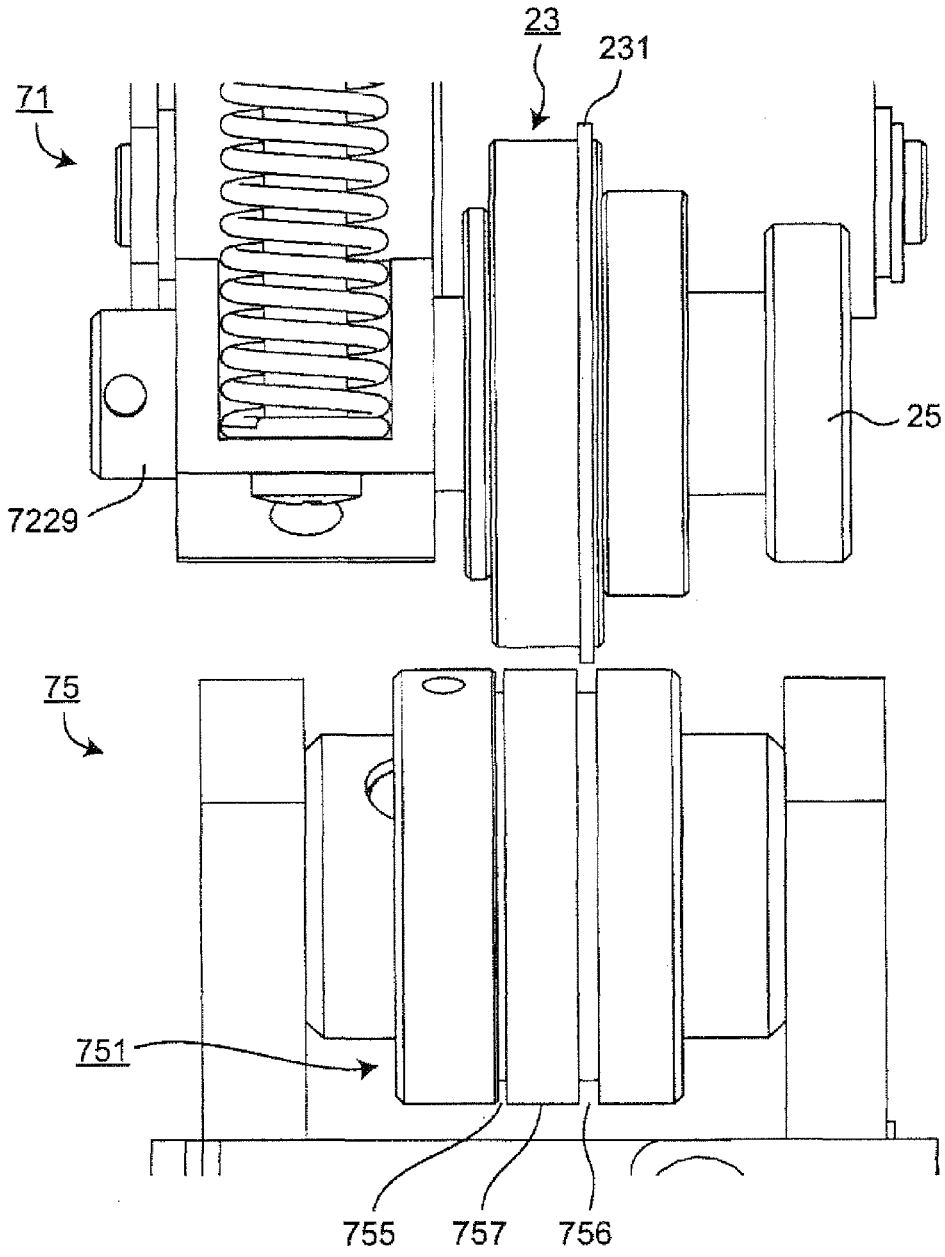
FIG. 9 is an enlarged view of the relevant part in a case where a creasing blade is attached as the processing blade.
Figure 10:
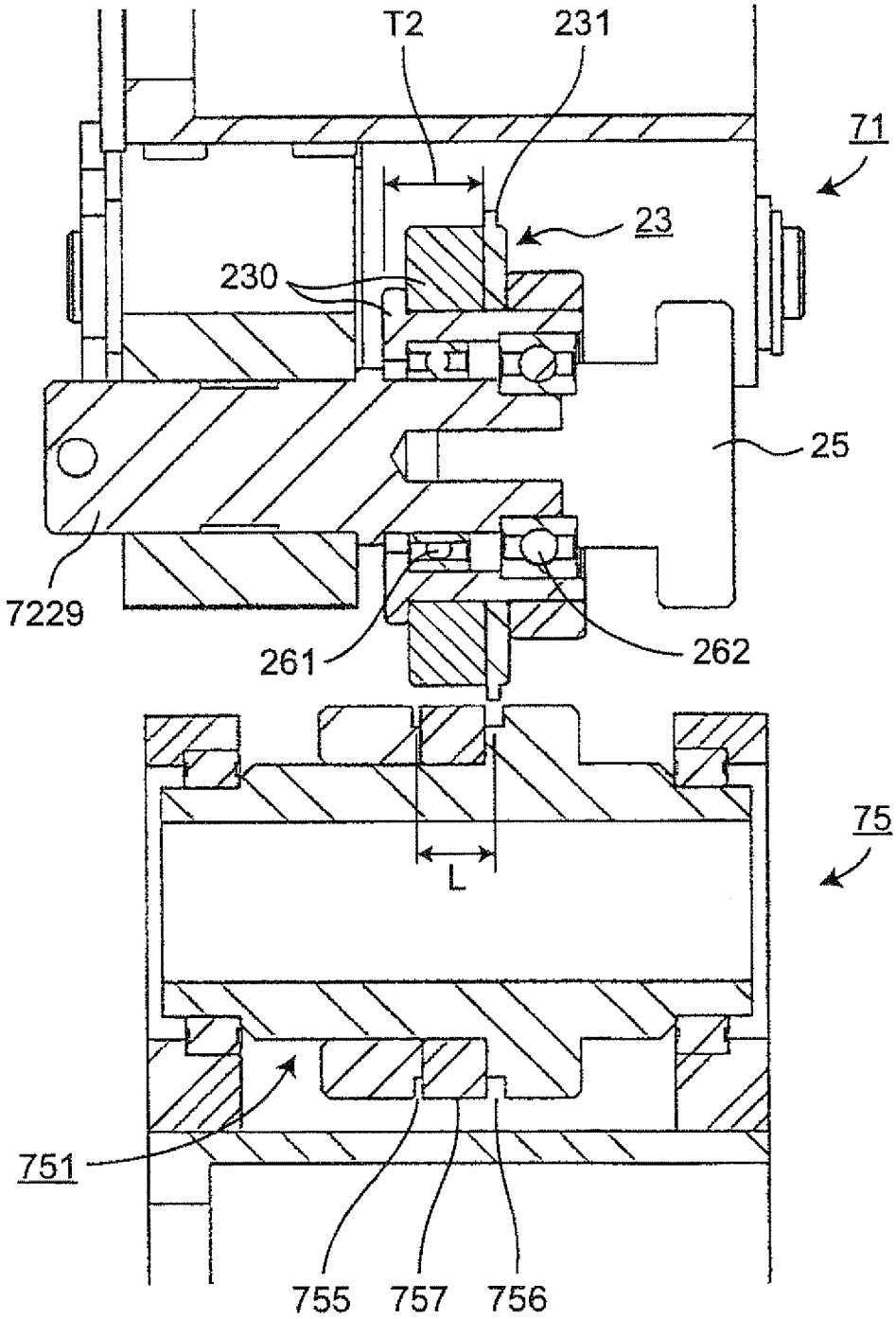
FIG. 10 is a longitudinal cross-sectional view of the relevant part shown in FIG. 9.
Figure 11:
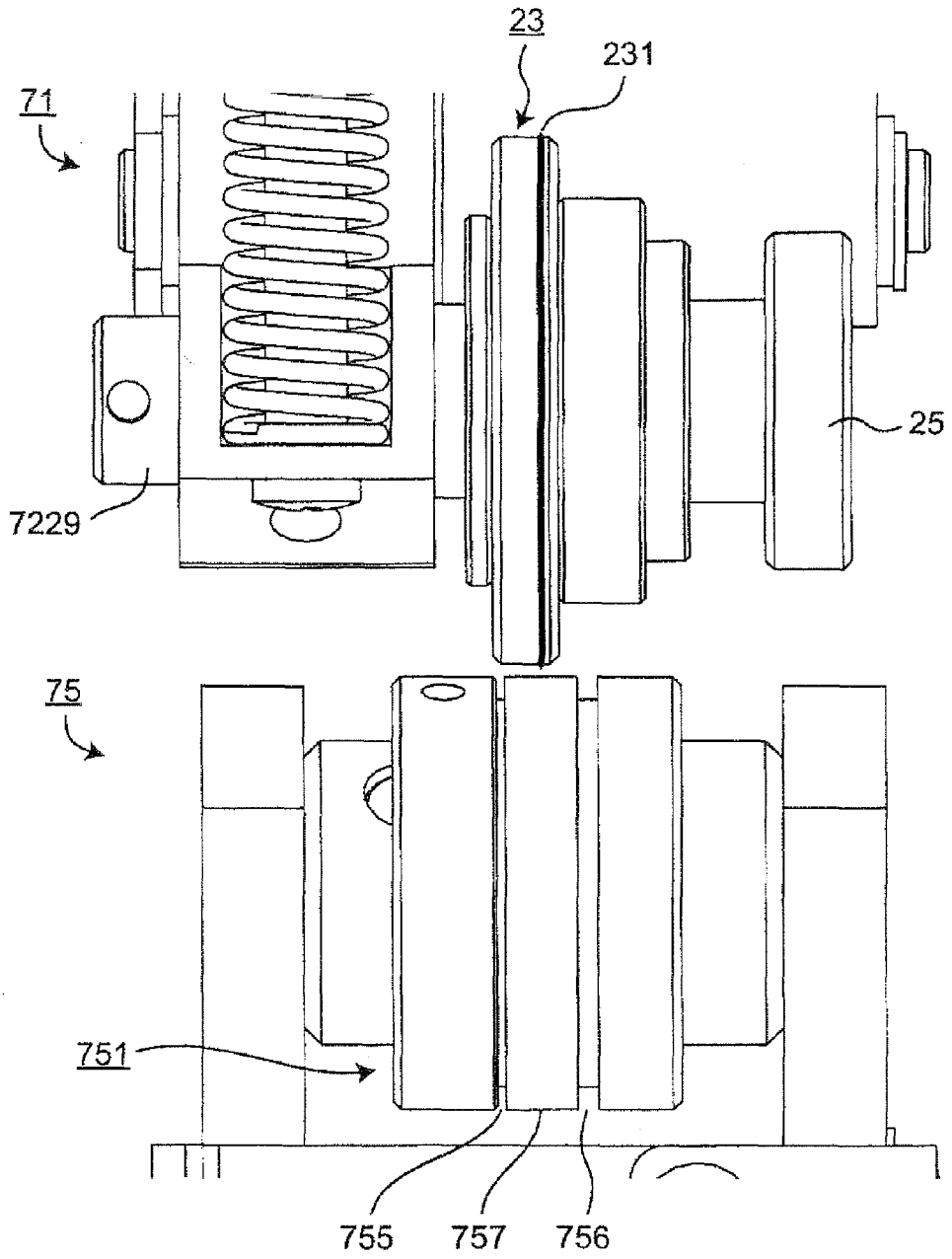
FIG. 11 is an enlarged view of the relevant part in a case where a half-cutting blade is attached as the processing blade.
Figure 12:
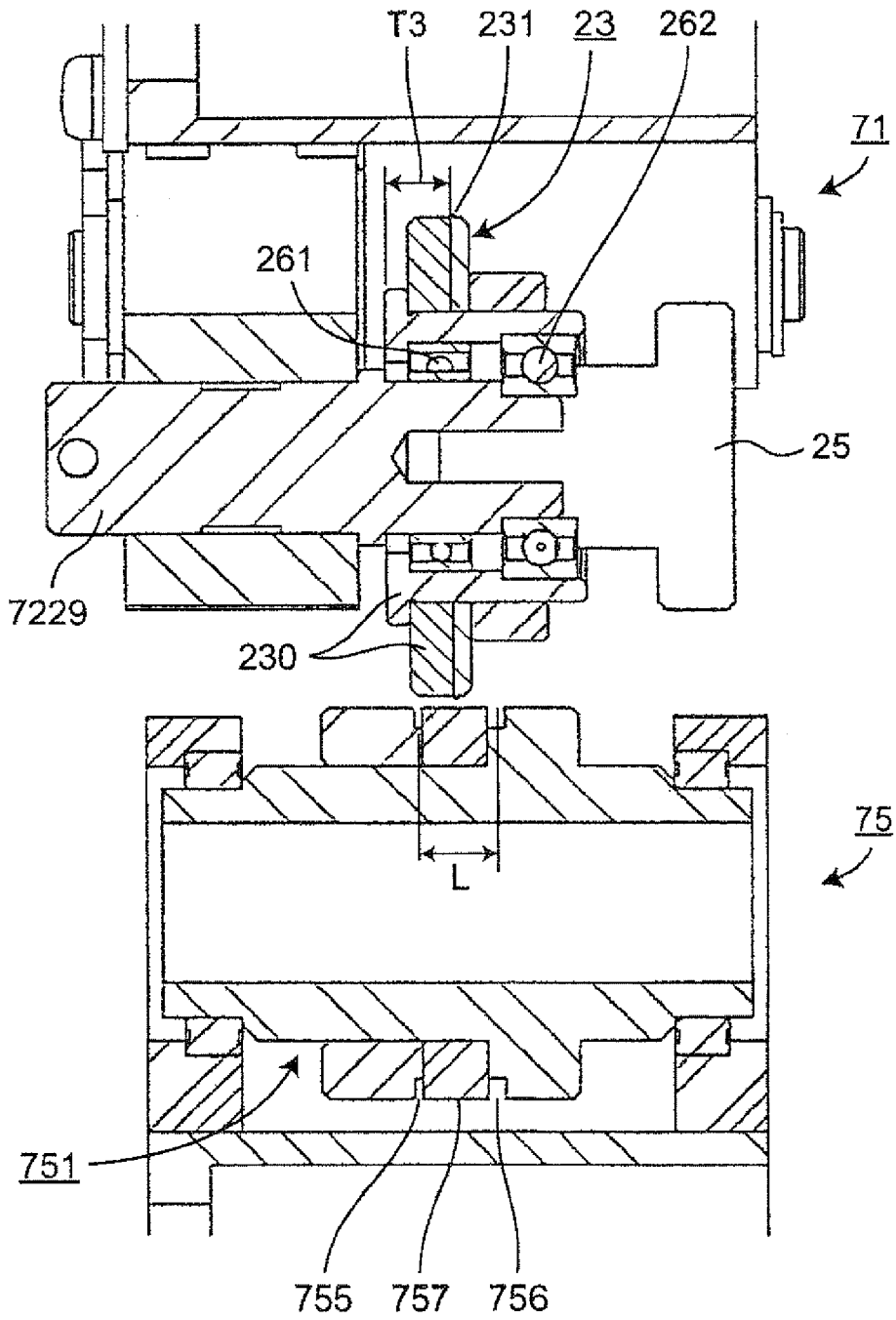
FIG. 12 is a longitudinal cross-sectional view of the relevant part shown in FIG. 11.
Figure 13:
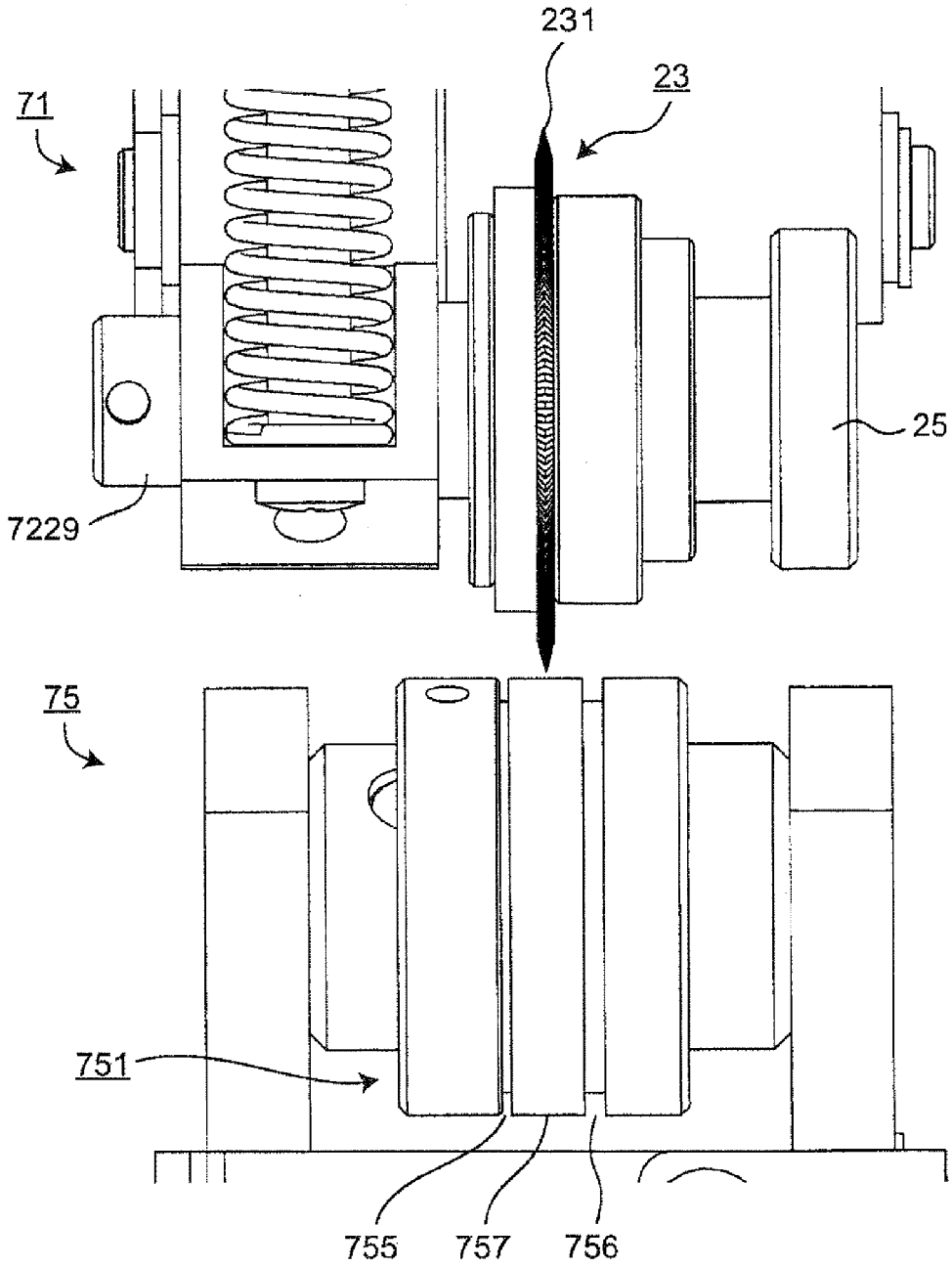
FIG. 13 is an enlarged view of the relevant part in a case where a micro-perforating blade is attached as the processing blade.
Figure 14:
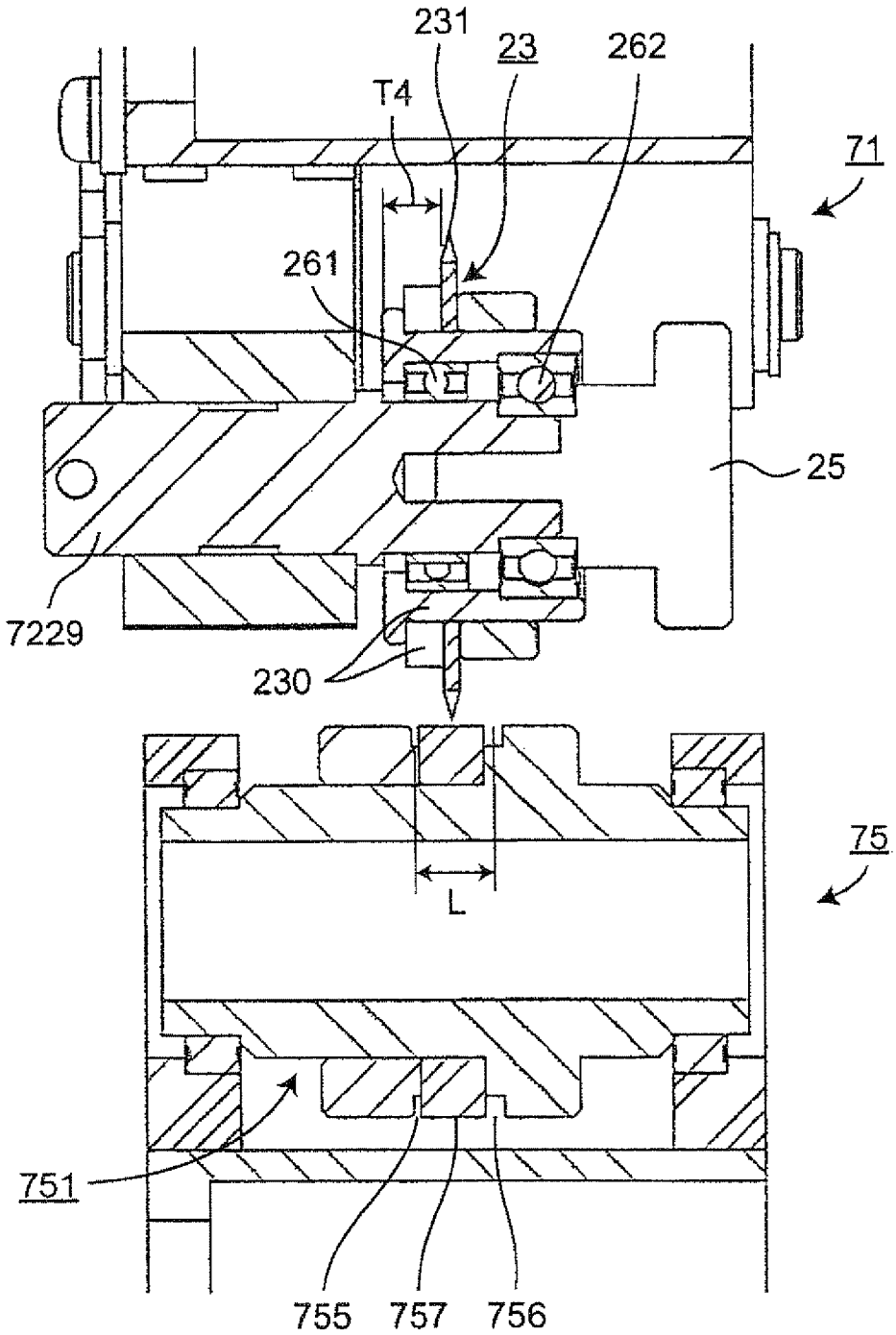
FIG. 14 is a longitudinal cross-sectional view of the relevant part shown in FIG. 13.

FIG. 7 is an enlarged view of a relevant part of FIG. 5, and shows a case where a perforating blade is attached as the processing blade 23. FIG. 8 is a longitudinal cross-sectional view of the relevant part shown in FIG. 7. The processing blade 23 is rotatably fitted on a shaft 7229 supported by the processor 71 through bearings 261 and 262, and is attached by a clamp 25 screwed into the shaft 7229. Therefore, the processing blade 23 is detachably attachable to the shaft 7229. A creasing blade, a half-cutting blade and a micro-perforating blade are also detachably attachable to the shaft 7229 like the perforating blade. Therefore, as the processing blade 23, another processing blade of the blade group, that is, a creasing blade, a half-cutting blade or a micro-perforating blade is attachable to the shaft 7229 in exchange of the perforating blade. That is, the processing blade 23 can be changed among the blade group consisting of a perforating blade, a creasing blade, a half-cutting blade and a micro-perforating blade. In the processor 71, since the side of the shaft 7229 to which the processing blade 23 is attached is open space, the processing blade 23 and the clamp 25 are easily attached to the shaft 7229. FIG. 9 is an enlarged view of the relevant part in a case where a creasing blade is attached as the processing blade 23. FIG. 10 is a longitudinal cross-sectional view of the relevant part shown in FIG. 9. FIG. 11 is an enlarged view of the relevant part in a case where a half-cutting blade is attached as the processing blade 23. FIG. 12 is a longitudinal cross-sectional view of the relevant part shown in FIG. 11. FIG. 13 is an enlarged view of the relevant part in a case where a micro-perforating blade is attached as the processing blade 23. FIG. 14 is a longitudinal cross-sectional view of the relevant part shown in FIG. 13.

Figure 15:
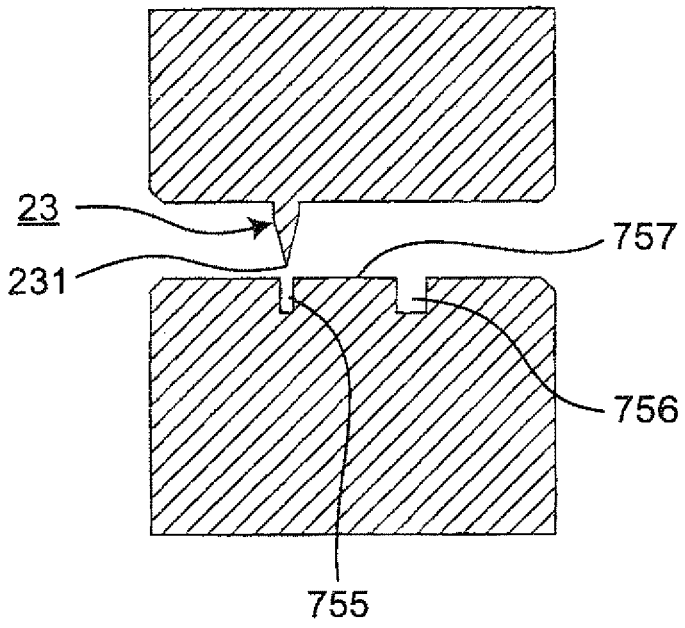
FIG. 15 is a schematic cross-sectional view showing the correspondence between the perforating blade and a reception member.
Figure 16:
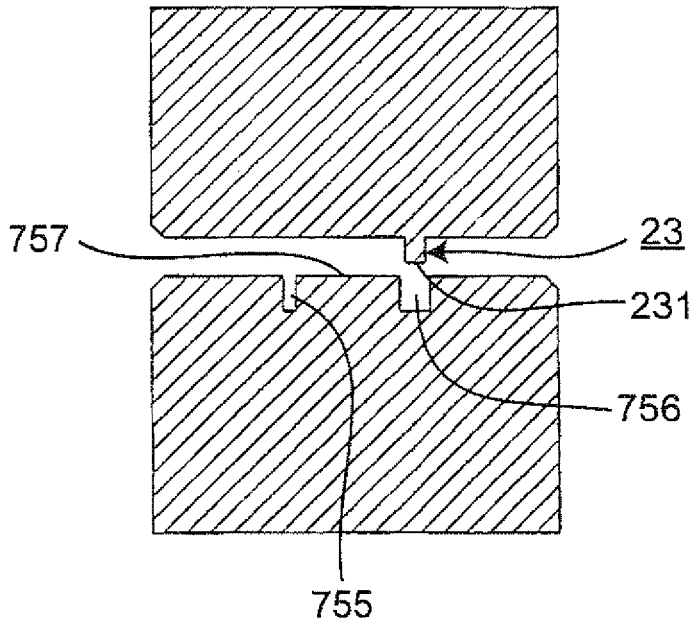
FIG. 16 is a schematic cross-sectional view showing the correspondence between the creasing blade and the reception member.
Figure 17:
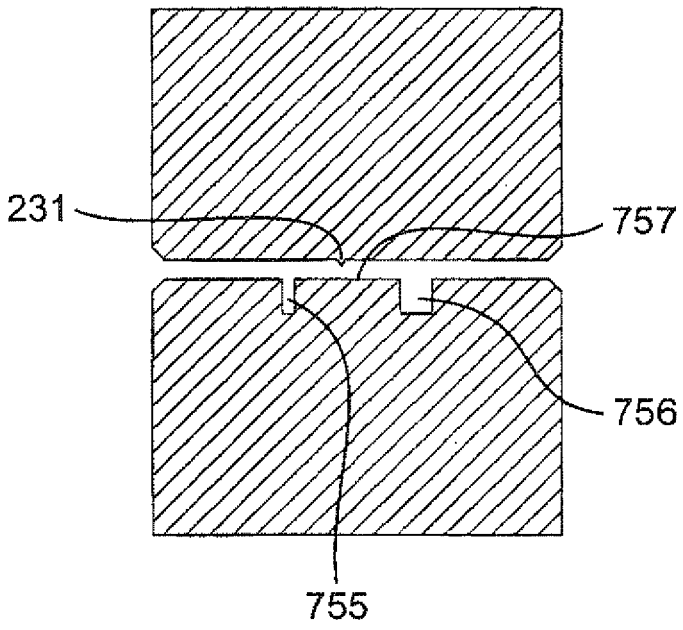
FIG. 17 is a schematic cross-sectional view showing the correspondence between the half-cutting blade and the reception member.
Figure 18:
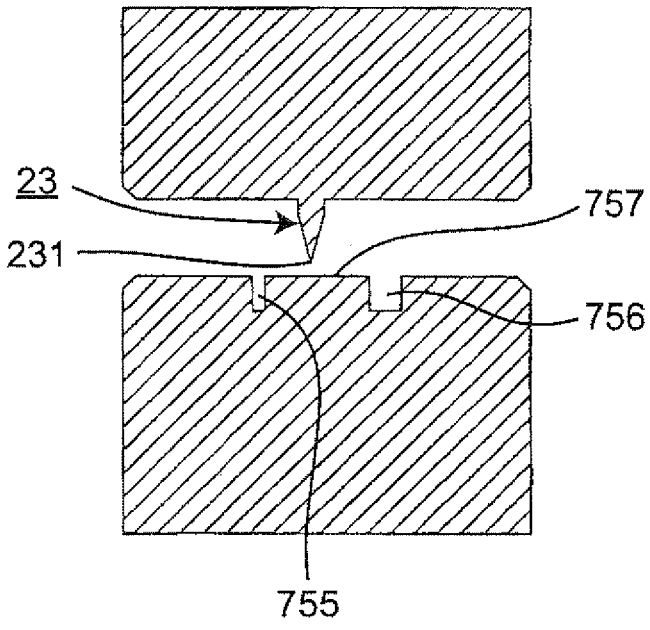
FIG. 18 is a schematic cross-sectional view showing the correspondence between the micro-perforating blade and the reception member.

On the other hand, a first reception portion 755 provided for the perforating blade, a second reception portion 756 provided for the creasing blade and a third reception portion 757 provided for the half-cutting blade and the micro-perforating blade are formed on the reception member 751. The first reception portion 755 is a groove into which the blade edge 231 of the processing blade 23 which is a perforating blade is inserted. The second reception portion 756 is a groove into which the blade edge 231 of the processing blade 23 which is the creasing blade is inserted. The groove of the second reception portion 756 is wider than the groove of the first reception portion 755, and is a distance L away from the first reception portion 755. The third reception portion 757 is a peripheral surface of the reception member 751, and is an area of the distance L between the first reception portion 755 and the second reception portion 756. FIGS. 15 to 18 are schematic cross-sectional views showing the correspondence between the kind of the processing blade 23 and the reception member 751. FIG. 15 show a case of the perforating blade, FIG. 16 shows a case of the creasing blade, FIG. 17 shows a case of the half-cutting blade, and FIG. 18 shows a case of the micro-perforating blade.

As shown in FIGS. 7 to 14, the processing blade 23 has a boss portion 230. For example, in the case of the processing blade 23 which is a perforating blade, the thickness T1 of the boss portion 230 is set so that the blade edge 231 is situated in a position opposed to the first reception portion 755, that is, in an engageable position when the processing blade 23 is attached to the processor 71. In the case of the processing blade 23 which is a creasing blade, the thickness T2 of the boss portion 230 is set so that the blade edge 231 is situated in a position opposed to the second reception portion 756, that is, in an engageable position when the processing blade 23 is attached to the processor 71. The thickness T2 is larger than the thickness T1 substantially by L. In the case of the processing blade 23 which is a half-cutting blade, the thickness T3 of the boss portion 230 is set so that the blade edge 231 is situated in a position opposed to substantially the center of the third reception portion 757, that is, in an engageable position when the processing blade 23 is attached to the processor 71. In the case of the processing blade 23 which is a micro-perforating blade, the thickness T4 of the boss portion 230 is set so that the blade edge 231 is situated in a position opposed to substantially the center of the third reception portion 757, that is, in an engageable position when the processing blade 23 is attached to the processor 71. Consequently, only by being attached to the processor 71, the processing blade 23 of each kind can be positioned in the position where the blade edge 231 thereof can be engaged with the reception portion of the corresponding kind.

(b) Rotation Mechanism

The rotation mechanism has a drive shaft 64. The drive shaft 64 is laid between the left side plate 512 and the right side plate 513. The reception member 751 is provided so as to rotate together with the drive shaft 64. The processing blade 23 is provided so as to rotate together with the reception member 751 along with the conveyed paper sheet in a close condition with respect to the reception member 751.

(c) Width Direction Movement Mechanism

In FIG. 3, threaded shafts 61A and 61B are screwed into protrusions 703 on top of upper bodies 71 of the processing machines 7A and 7B, respectively. When the threaded shafts 61A and 61B rotate, the upper bodies 71 move in the width direction W along a guide shaft 63 below the threaded shafts 61A and 61B. Likewise, threaded shafts 66A and 66B are screwed into protrusions 752 on the bottom of lower bodies 75 of the processing machines 7A and 7B, and when the threaded shafts 66A and 66B rotate, the lower bodies 75 move in the width direction W along a guide shaft 65. The width direction movement mechanism of the processing machines 7A and 7B is thus constituted by the upper threaded shafts 61A and 61B and the guide shaft 63, and the lower threaded shafts 66A and 66B and the guide shaft 65.

The threaded shafts 66A and 66B placed in a lower part are coupled to the threaded shafts 61A and 61B placed in an upper part by a power transmission mechanism (not shown), and rotate in synchronism by being driven by a horizontal direction driver (described later).

As shown in FIG. 3, the threaded shafts 61A, 61B, 66A and 66B and the guide shafts 63 and 65 are laid parallel to the drive shaft 64 between the left side plate 512 and the right side plate 513. The threaded shaft 61A hanging the processor 71 of the processing machine 7A and the threaded shaft 61B hanging the processor 71 of the processing machine 7B are juxtaposed in positions at the same height in an upper part of the internal space 500. On the other hand, the threaded shaft 66A supporting the receiver 75 of the processing machine 7A from below and the threaded shaft 66B supporting the receiver 75 of the processing machine 7B from below are juxtaposed in positions at the same height in a lower part of the internal space 500.

(d) Approaching and Separating Mechanism

The approaching and separating mechanism moves the processing blade 23 between a close position and a separated position with respect to the reception member 751. In the present embodiment, the approaching and separating direction is the vertical direction.

As shown in FIG. 4, the upper body 71 has a cam member 721 and a swinging lever 722. The cam member 721 is provided so as to rotate together with a cam rotation shaft 62. The cam rotation shaft 62 is laid between the left side plate 512 and the right side plate 513 at the same height as the guide shaft 63 on the downstream side of the guide shaft 63. The cam rotation shaft 62 is used by both of the cam members 721 of the left and right processing machines 7A and 7B, and rotates the cam members 721 at the same time by the same amount.

The swinging lever 722 swings around a pivot 7223 in conjunction with the rotation of the cam member 721 situated near one end portion 7221, and moves a swinging end portion 7222 on the side of the other end portion in the vertical direction, thereby swinging the processing blade 23 in the approaching and separating direction. On the rotation shaft 7229 provided on the swinging end portion 7222, the processing blade 23 is supported so as to be rotatable and detachably attachable. That is, the swinging end portion 7222 supports the processing blade 23 so as to be detachably attachable. The processing blade 23 can be detached from the swinging end portion 7222 by detaching the clamp 25 shown in FIG. 5 from the shaft 7229 of the swinging end portion 7222.

Figure 19:
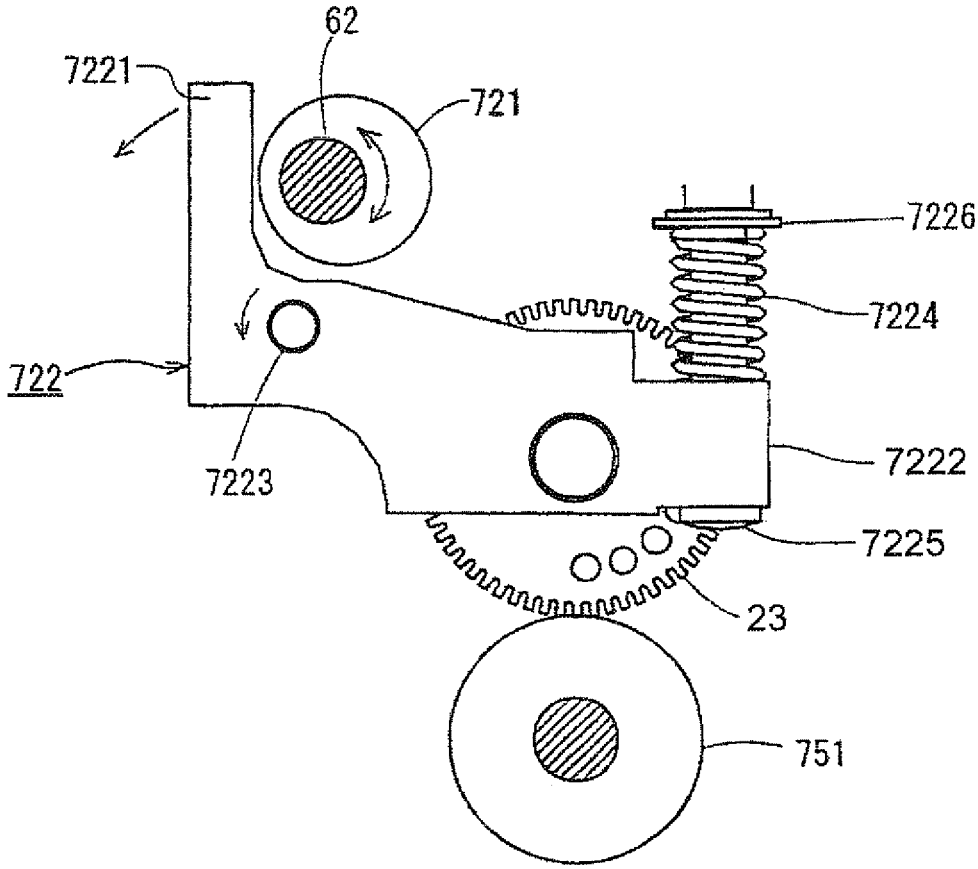
FIG. 19 is a side view showing a condition where the processing blade is in a close position with respect to the reception member.
Figure 20:
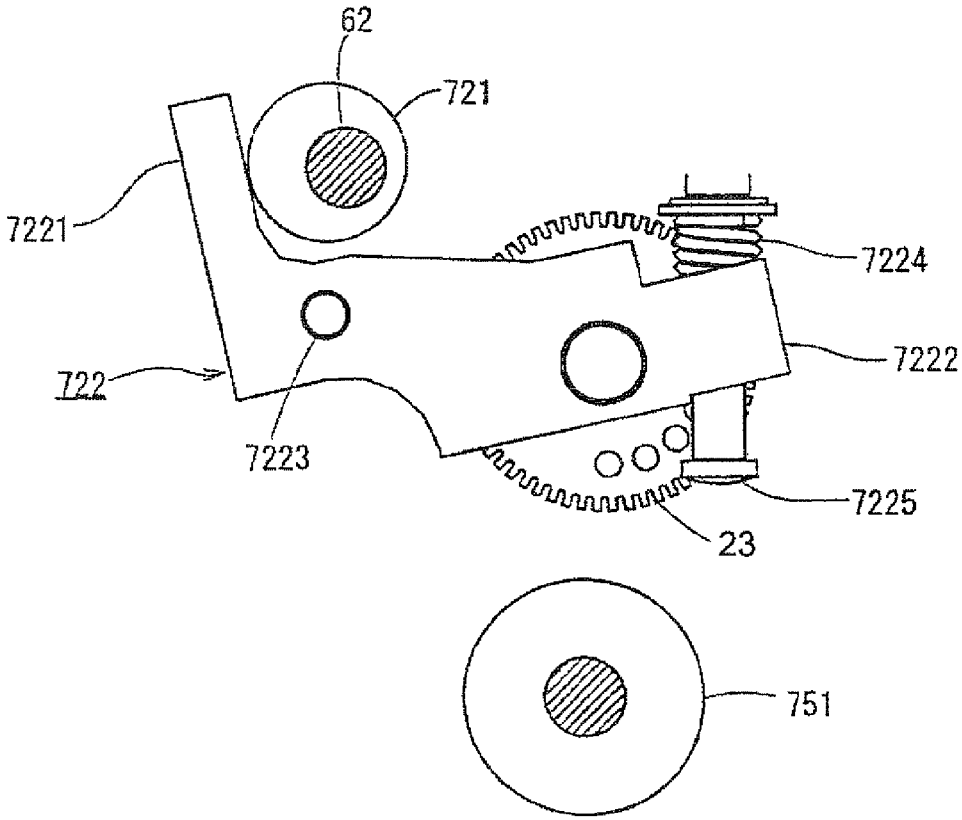
FIG. 20 is a side view showing a condition where the processing blade is in a separated position separated from the reception member.

The swinging end portion 7222 is pushed downward toward an abutment member 7225 by a pushing member. 7224, whereby the one end portion 7221 of the swinging lever 722 is pushed toward the cam member 721. That is, when the cam member 721 rotates, the swinging end portion 7222 of the swinging lever 722 swings in the vertical direction, this moves the processing blade 23 in the vertical direction, and consequently, the processing blade 23 approaches and separates from the reception member 751. FIG. 19 shows a condition where the processing blade 23 is in the close position with respect to the reception member 751, and FIG. 20 shows a condition where the processing blade 23 is in the separated position separated from the reception member 751.

The rotation amount of the cam member 721 is detected by a cam rotation amount detector 723 (FIG. 3). The cam rotation amount detector 723 is provided outside the left side plate 512. The cam rotation amount detector 723 detects the rotation amount of the cam rotation shaft 62 to thereby detect the rotation amount of the cam member 721. Then, the cam rotation amount detector 723 detects the time when the smaller diameter part of the cam member 721 is opposed to the one end portion 7221 and the vertical position of the processing blade 23 is the lowermost position, that is, the close position as shown in FIG. 19 and the time when the larger diameter part of the cam member 721 abuts on the one end portion 7221 and the vertical position of the processing blade 23 is the uppermost position, that is, the separated position as shown in FIG. 20.

The mechanism for adjusting the pushing amount of the processing blade 23 is as follows: Into an upper part 711 of the processor 71, a rod 725 is screwed in the vertical direction. On the lowermost end of the rod 725, the abutment member 7225 is provided. To the lower exposed part of the rod 725, a flange 7226 is fixed at a distance from the abutment member 7225, and the pushing member 7224 is disposed between the abutment member 7225 and the flange 7226. Consequently, when the swinging lever 7222 abuts on the abutment member 7225, that is, when the processing blade 23 is in the close position, the pushing member 7224 is held at the same length at all times, and therefore, pushes the swinging end portion 7222, that is, the processing blade 23 with the same strength at all times. On the upper end of the rod 725, a knob 7227 is provided. When the knob 7227 is rotated, the rod 725 moves vertically, thereby adjusting the vertical position of the abutment member 7225. Consequently, the lowermost position of the processing blade 23 is adjusted, so that the pushing amount of the processing blade 23 is adjusted.

(e) Reader

The reader has an optical sensor 44 that reads the identification information of the processing blade 23 attached to the processor 71.

(e–1) Identification Information of the Processing Blade 23

Figure 21:
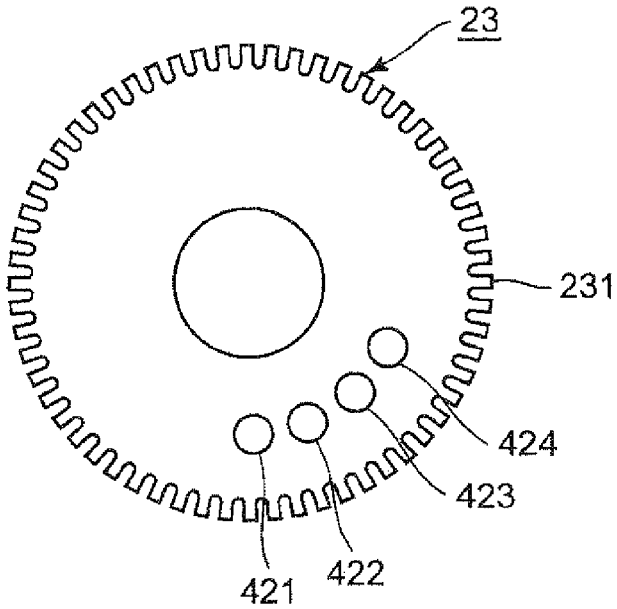
FIG. 21 is a side view of the processing blade which is a perforating blade.
Figure 22:
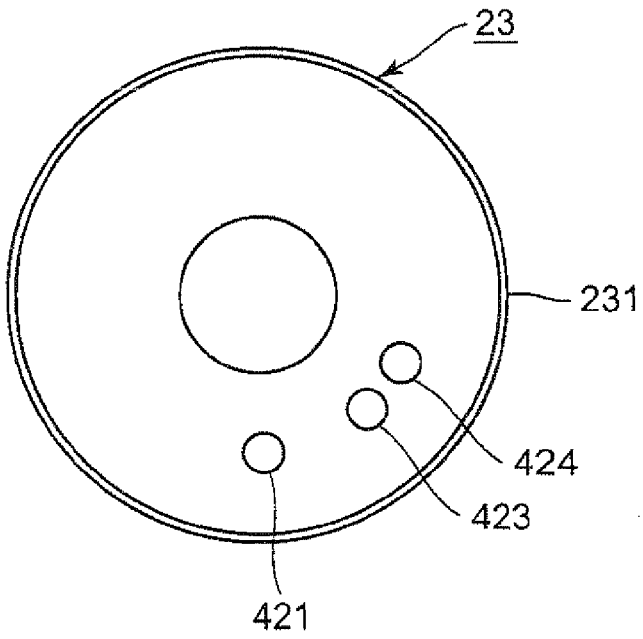
FIG. 22 is a side view of the processing blade which is a creasing blade.
Figure 23:
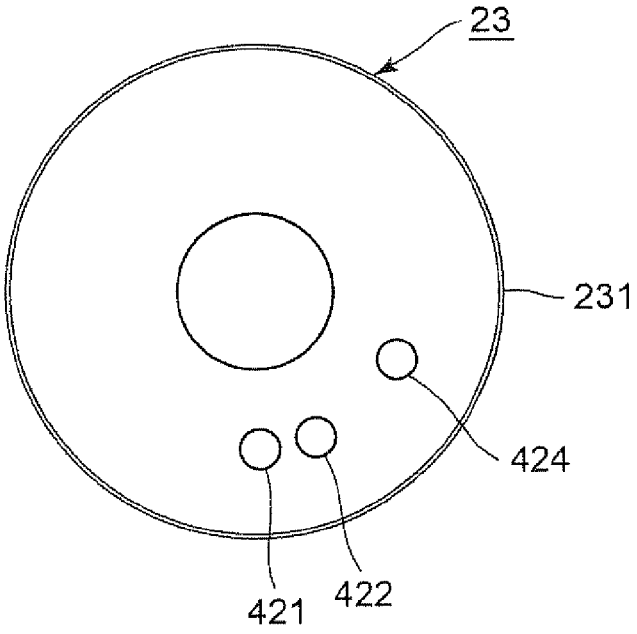
FIG. 23 is a side view of the processing blade which is a half-cutting blade.
Figure 24:
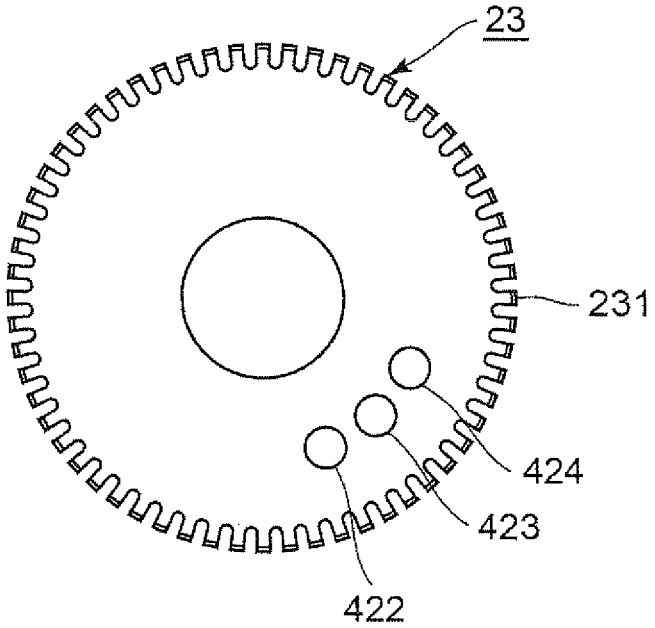
FIG. 24 is a side view of the processing blade which is a micro-perforating blade.

The identification information of the processing blade 23 is, for example, a disposition pattern of a plurality of through holes formed in the processing blade 23. Specifically, FIG. 21 is a side view of the processing blade 23 which is a perforating blade. In the perforating blade, four through holes 421, 422, 423 and 424 are formed at regular intervals in positions equidistant from the center of rotation. That is, the identification information of the perforating blade is a disposition pattern formed of the four continuous through holes 421, 422, 423 and 424. FIG. 22 is a side view of the processing blade 23 which is a creasing blade. The identification information of the creasing blade is a disposition pattern which is the disposition pattern formed of the four continuous through holes 421, 422, 423 and 434 from which the through hole 422 is eliminated. FIG. 23 is a side view of the processing blade 23 which is a half-cutting blade. The identification information of the half-cutting blade is a disposition pattern which is the disposition pattern formed of the four continuous through holes 421, 422, 423 and 434 from which the through hole 423 is eliminated. FIG. 24 is a side view of the processing blade 23 which is a micro-perforating blade. The identification information of the micro-perforating blade is a disposition pattern which is the disposition pattern formed of the four continuous through holes 421, 422, 423 and 424 from which the through hole 421 is eliminated. These through holes can be easily formed when the processing blade 23 is manufactured.

(e-2) Sensor 44

The sensor 44 that reads the identification information of the processing blade 23 of the processing machine 7B is provided on the inner surface of the right side plate 513 so as to be opposed to the processing blade 23. The sensor 44 that reads the identification information of the processing blade 23 of the processing machine 7A is provided on the inner surface of the left side plate 512 so as to be opposed to the processing blade 23. The sensor 44 has a light emitting portion and a light receiving portion, and reads the reflected light from the side surface of the processing blade 23. For example, when the processing machine 7B is situated in the home position near the right side plate 513, the processing blade 23 is rotated along with the rotation of the reception member 751, whereby the disposition pattern of the through holes formed in the processing blade 23 is read by the sensor 44. That is, the identification information of the processing blade 23, in this case, the kind of the processing blade 23 is detected.

(f) Part of the Unit Detector

Light intercepting plates 716 and 717 are provided in two positions of the bottom frame 514. When the processing unit 51 is attached to the acceptance portion 52, the light intercepting plates 716 and 717 function as unit detectors that detect the kind of the processing unit 51 in conjunction with sensors 981 and 982 of the acceptance portion 52.

(Acceptance Portion)

Figure 25:
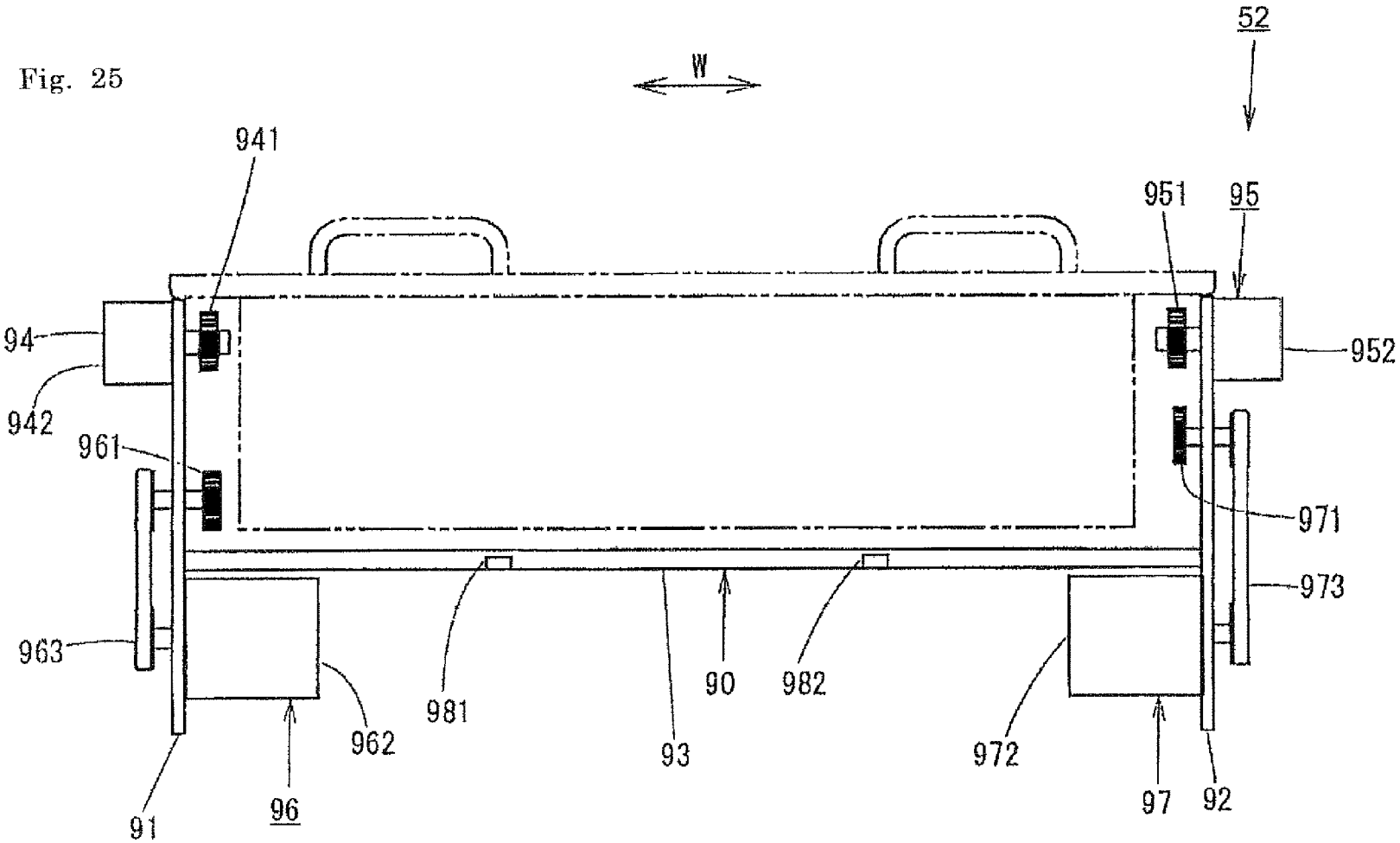
FIG. 25 is a front view of an acceptance portion viewed from the upstream side.

FIG. 25 is a front view of the acceptance portion 52 viewed from the upstream side. The acceptance portion 52 includes a plurality of drivers and part of the unit detector on a frame member 90 constituted by a left side plate 91, a right side plate 92 and a lower frame 93.

(a) Drivers

The drivers are a first driver 94, a second driver 95, a third driver 96 and a fourth driver 97.

The first driver 94 is provided on an upper part of the left side plate 91, and includes a gear 941 situated on the inside of the left side plate 91 and a motor 942 situated on the outside of the left side plate 91 to rotate the gear 941.

The second driver 95 is provided on an upper part of the right side plate 92, and includes a gear 951 situated on the inside of the right side plate 92 and a motor 952 situated on the outside of the right side plate 92 to rotate the gear 951.

The third driver 96 is provided on a lower part of the left side plate 91, and includes a gear 961 situated on the inside of the left side plate 91 and above the lower frame 93, a motor 962 situated on the inside of the left side plate 91 and below the lower frame 93, and a power transmission portion 963 such as a gear or a pulley situated on the outside of the left side plate 91 to transmit the driving force of the motor 962 to the gear 961.

The fourth driver 97 is provided on a lower part of the right side plate 92, and includes a gear 971 situated on the inside of the right side plate 92 and above the lower frame 93, a motor 972 situated on the inside of the right side plate 92 and below the lower frame 93, and a power transmission portion 973 such as a gear or a pulley situated on the outside of the right side plate 92 to transmit the driving force of the motor 972 to the gear 971.

When the processing unit 51 is attached to the acceptance portion 52, the first driver 94 is coupled to the threaded shaft 61A of the width direction movement mechanism of the processing machine 7A, the second driver 95 is coupled to the threaded shaft 61B of the width direction movement mechanism of the processing machine 7B, the third driver 96 is coupled to the drive shaft 64 of the rotation mechanism of the processing machines 7A and 7B, and the fourth driver 97 is coupled to the cam rotation shaft 62 of the approaching and separating mechanism of the processing machines 7A and 7B. That is, the first driver 94 and the second driver 95 function as the drivers of the width direction movement mechanism, the third driver 96 functions as the driver of the rotation mechanism, and the fourth driver 97 functions as the driver of the approaching and separating mechanism.

(b) Part of the Unit Detector

Optical sensors 981 and 982 are provided in two positions of the lower frame 93. The sensors 981 and 982 are provided in positions opposed to the light intercepting plates 716 and 717 of the processing unit 51, and constitute unit detectors together with the light intercepting plates 716 and 717. When the processing unit 51 is attached to the acceptance portion 52, the light transmission to the sensors 981 and 982 are intercepted by the light intercepting plates 716 and 717, whereby the attachment is detected. By making the pattern of presence or absence of the light intercepting plates 716 and 717 different according to the kind of the processing unit, the unit detectors can identify the kind of the processing unit.

As the first processing device unit 3 and the second processing device unit 4, processing device units known in the field of this kind of paper sheet processing device may be used, or processing device units having a structure similar to that of the third processing device unit 5 may be used. In the latter case, the kinds and the number of processing blades constituting the blade group may be changed arbitrarily.

[Controller]

The controller 6 controls the driver of the conveyance portion and the first to fourth drivers 94, 95, 96 and 97 according to the set processing information.

Moreover, the controller 6 has a kind detector that detects the kind of the processing blade 23 based on the identification information of the processing blade 23 read by the reader (sensor 44). When the sensor 44 detects, for example, the disposition pattern of four continuous through holes, the kind detector detects that the processing blade 23 is a perforating blade.

Moreover, the controller 6 has a movement adjuster that adjusts, based on the detected kind of the processing blade 23, the width direction movement mechanism and the drivers thereof so that the position of the blade edge 231 of the processing blade 23 coincides with the processing position of the paper sheet in the set processing information. For example, in a case where the set processing information represents performing perforation processing in a position in a width direction Wa and a perforating blade is attached to the processor 71 as the processing blade 23, when the processing blade 23 is changed to a creasing blade in order to perform folding processing in the same position in the width direction Wa instead of perforation processing, the movement adjuster operates as follows: When the perforating blade is changed to a creasing blade, as is apparent from FIG. 8, the position of the blade edge 231 is shifted outward in the width direction by the distance L. Therefore, if the processing machine 7B is operated under that condition, folding processing is performed in a position shifted outward by the distance L from the position in the width direction Wa. Therefore, the movement adjuster additionally moves the processing machine 7B inward in the width direction by the distance L to thereby adjust the width direction movement mechanism and the driving portions thereof so that the blade edge 231 of the creasing blade is situated in the position in the width direction Wa.

Further, the controller 6 has a stopper that compares the detected kind of the processing blade 23 and the kind of the processing blade required for executing the set processing information with each other and when the kinds do not coincide with each other, stops the initiation of operation of the processing machine. For example, when the kind of the processing blade required for executing the set processing information is a creasing blade although the detected kind of the processing blade 23 is a perforating blade, since the kinds do not coincide with each other, the stopper stops the initiation of operation of at least the third driver 96 of the first to fourth drivers 94, 95, 96 and 97.

[Operation]

The operation of the paper sheet processing device of the present embodiment will be described.

First, the processing information of the paper sheet is set with the setting portion 601. Although this setting is normally made by the operator operating the operation panel 60, it may be made by automatically reading, by an information reading portion (not shown), a bar code representative of the processing information printed on the paper sheet, together with the position mark.

Then, when it is intended to perform perforation processing on the paper sheet along the conveyance direction S, the operator attaches to the acceptance portion 52 the processing unit 51 to which the perforating blade is attachable as the processing blade 23. When the processing unit 51 is attached to the acceptance portion 52, the sensors 981 and 982 and the light intercepting plates 716 and 717 detect that the attached processing unit 51 is the processing unit to which a perforating blade is attachable. The detection result is displayed on the display portion 602 by the controller 6. This enables the operator to know that the correct processing unit is attached.

Then, by being controlled by the controller 6, the reception member 751 rotates under a condition where the processing machines 7A and 7B are in the home positions, and the processing blade 23 rotates several times along with this and then, stops. While the processing blade 23 is rotating, the disposition pattern of the through holes of the processing blade 23 is read by the sensor 44. The reading result is transmitted to the controller 6, and the kind of the processing blade 23 is detected from the disposition pattern of the through holes by the kind detector of the controller 6. The detection result is displayed on the display portion 602 by the controller 6. This enables the operator to easily confirm the kind of the processing blade 23 of the processing machines 7A and 7B on the operation panel 60. Consequently, the operator can save the trouble of taking out the processing unit 51 from the acceptance portion 52 in order to confirm the kind of the processing blade 23 and visually confirming it.

On the other hand, at the controller 6, the kind of the processing blade 23 detected by the kind detector and the kind of the processing blade required for executing the processing information set with the setting portion 601 are compared with each other, and when the kinds do not coincide with each other, the stopper operates to stop the initiation of operation of the processing machines 7A and 7B. At the same time, it is indicated that they do not coincide with each other on the display portion 602. This enables the operator to easily know that an incorrect processing blade 23 is attached. Thereby, the paper sheet can be prevented from being erroneously processed, and the operator is prompted to change the processing blade 23.

On the contrary, when the kind of the processing blade 23 detected by the kind detector and the kind of the processing blade required for executing the processing information set with the setting portion 601 coincide with each other, the operation is continued. That is, according to the control by the controller 6, the paper sheet is supplied from the paper feed portion 11, successively processed by the first processing device unit 3 and the second processing device unit 4 while conveyed on the conveyance path 20, and are further processed by the third processing device unit 5 to be discharged to the paper ejection portion 12.

The operation at the third processing device unit 5 is as follows:

First, by being controlled by the controller 6, the first driver 94 and the second driver 95 are driven, so that the processing machines 7A and 7B are moved to the predetermined position Wa in the width direction W where perforations are to be formed. At this time, the processing blade 23 is situated in the close position with respect to the reception member 751. Then, by being controlled by the controller 6, the third driver 96 is driven, so that the drive shaft 64 is rotated to rotate the reception member 751 and the processing blade 23. Thereby, the paper sheet is conveyed toward the downstream side while being sandwiched between the processing blade 23 and the reception member 751. At this time, the processing blade 23 rotates as the paper sheet is conveyed while the blade edge 231 thereof passes through the paper sheet to be inserted into the groove of the first reception portion 755. As a result, perforations of a predetermined length along the conveyance direction S are formed in an area where perforations are to be formed in the paper sheet.

On the other hand, in the area where no perforations are formed, by being controlled by the controller 6, the fourth driver 97 is driven based on the detection result of the cam rotation amount detector 723 to rotate the cam rotation shaft 62 by a predetermined amount. Thereby, the cam member 721 rotates to move the swinging end portion 7222 of the swinging lever 722 upward with respect to the reception member 751, so that the processing blade 23 situated in the close position is separated from the reception member 751 to move to the separated position. As a result, while the paper sheet is being conveyed, no perforations are formed in the paper sheet since the processing blade 23 is separated from the reception member 751.

Then, when it is intended to perform folding processing instead of perforation processing at the third processing device unit 5, the operator performs the following operation: First, the processing unit 51 is taken out from the acceptance portion 52. Then, in the processing machines, the clamp 25 is detached, and the processing blade 23 which is a perforating blade is changed to a creasing blade. Then, the processing blade 23 which is a creasing blade is fixed to the shaft 7229 by the clamp 25. Then, the processing unit 51 is attached to the acceptance portion 52. The subsequent operation is the same as that in the case of the above-described perforation processing. However, the width direction movement mechanism and the drivers thereof are adjusted by the movement adjuster of the controller 6. That is, in the case of FIG. 5, the processing machine 7B is additionally moved in the width direction by the distance L, and as a result thereof, the blade edge 231 of the creasing blade is situated in the position in the width direction Wa.

[Effects]

According to the processing machine of the present embodiment, the following effects are delivered:

(1) Since the processing blade 23 can be changed among different kinds of processing blades 23, the kind of the processing blade of the processing machine can be easily changed.

(2) Since the processing blades 23 of the kinds are positioned in positions where the blade edges 231 thereof are engageable with the reception portions of the corresponding kinds only by being attached to the processor 71, the kind of processing at the processing machine can be easily changed also in this regard.

(3) Further, the structure for the positioning is easily realized since it is necessary only to set the thickness of the boss portion 230 according to the kind of the processing blade 23.

(4) Since the clamp 25 is a screw type, the detachment and attachment of the clamp 25 can be performed easily. Consequently, the processing blade 23 can be easily changed.

(5) Since the processing blades 23 of the blade group are four kinds of a perforating blade, a creasing blade, a half-cutting blade and a micro-perforating blade, four kinds of processings can be performed by one processing machine.

(6) Since the kinds of the reception portion of the reception member 751 are three of the first to third reception portions 755, 756 and 757 although the number of kinds of the changeable processing blade 23 is four, the structure of the reception member 751 can be simplified.

According to the paper sheet processing device of the present embodiment, the following effects are delivered:

(a) Whether the processing unit attached to the acceptance portion is the correct one or not can be detected by the unit detector. Consequently, erroneous processing can be prevented.

(b) Since the kind of the processing blade 23 can be detected by the kind detector of the controller 6, erroneous processing can be prevented.

(c) Since the kind of the processing blade 23 is displayed on the display portion 602, the kind of the processing blade 23 can be easily confirmed.

(d) Since the initiation of operation of the processing machine is stopped by the stopper of the controller 6 when the kind of the processing blade 23 detected by the kind detector and the kind of the processing blade required for executing the processing information set with the setting portion 601 do not coincide with each other, erroneous processing can be prevented.

(e) Since the width direction movement mechanism of the processing machine and the drivers thereof are adjusted by the movement adjuster of the controller 6 when the processing blade is changed, processing can be performed in the same processing position as the processing position, in the width direction, of the processing blade 23 before the change, by the processing blade 23 after the change without the processing information being re-set. Consequently, the processing after the change can be easily executed.

[Modification Structure]

(i) The kinds of the changeable processing blade 23 are not limited to the four kinds of the perforating blade, the creasing blade, the half-cutting blade and the micro-perforating blade, but may be two or three kinds of the four or may be five or more kinds. As an additional kind of the processing blade 23, a cutting blade or the like may be adopted.

(ii) The number of processing machines that the processing unit has is not limited to two, but may be one, or three or more. When the number of processing machines is three or more, the identification information of all the processing machines can be read by providing the processing machines with the sensor 44 as required.

(iii) The clamp 25 is not limited to a screw type, but may be a key type or a magnet type.

(iv) The disposition pattern of the through holes representative of the identification information of the processing blade 23 is not limited to the cases shown in FIGS. 21 to 24, but may be a different pattern. For example, the through holes may be formed so as to be distributed on the entire area of the side surface of the processing blade 23 instead of forming them so as to be unevenly distributed on part of the side surface. In that case, reduction in the strength of the processing blade 23 can be suppressed. Moreover, the through holes are not limited to circular ones.

(v) The identification information of the processing blade 23 may be a color arrangement pattern formed of a plurality of colors applied to the surface of the processing blade 23, may be magnetic materials having different pieces of data or reflecting materials having different reflectances which materials are pasted to the surface of the processing blade 23, or may be a different identifiable structure.

(vi) The identification information of the processing blade 23 may include not only the kind but also other pieces of information. As the other pieces of information, for example, the material, the thickness, the edge size, the manufacturing date and the expiration date for use may be adopted.

(vii) The sensor 44 may be structured so as to read not the reflected light but the transmitted light. In that case, for example, light receiving portions are provided to the processing machines 7A and 7B, and light emitting portions are provided to the left and right side plates 512 and 513.

(viii) The sensor 44 may be structured so as to operate only when the operator makes a request by operating the operation panel 60.

(ix) The display portion 602 is not essential.

(x) When the processing information is set while a plurality of patterns of processing information are prestored, selection from among the patterns may be made with the operation panel 60.

(xi) The unit detector may include three or more sensors and light intercepting plates to increase the number of patterns of presence or absence of light interception.

(xii) The kind of the processing blade 23 of the processing machine 7A and the kind of the processing blade 23 of the processing machine 7B may be different. In that case, two kinds of processings are performed by one processing device unit. The same applies when one processing device unit has three or more processing machines.

Second Embodiment

While the processing machines 7A and 7B of the processing unit 51 of the first embodiment performs processing along the conveyance direction S, or "longitudinal processing", the processing machines of the processing unit of the present embodiment performs processing along the width direction W, or "lateral processing".

Figure 26:
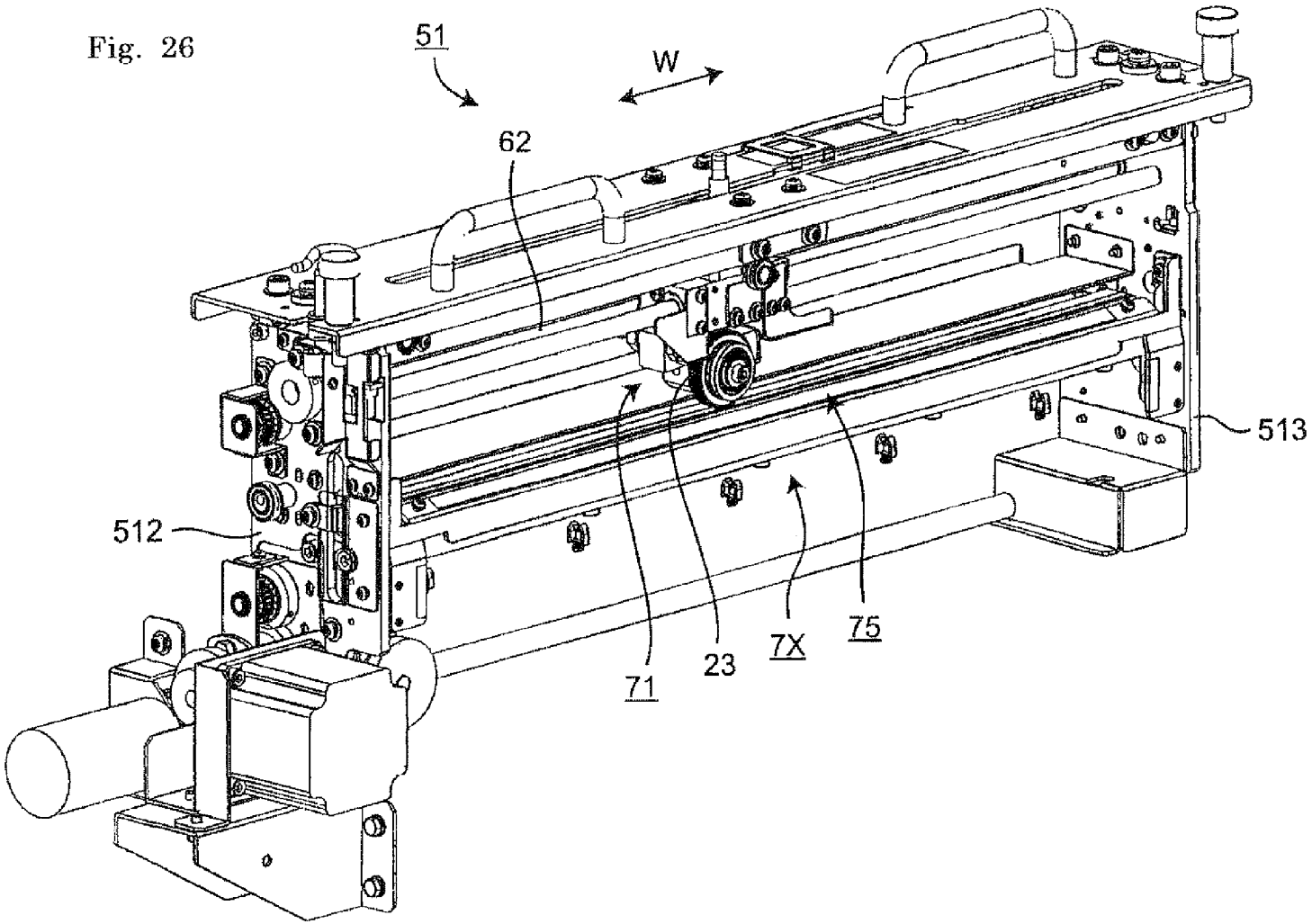
FIG. 26 is a perspective view of the processing unit of a second embodiment of the present invention viewed from the upstream side.

FIG. 26 is a perspective view of the processing unit 51 of the present embodiment viewed from the upstream side. This processing machine 7X includes a processor 71 that moves in the width direction W and a linear receiver 75 extending in the width direction W.

Figure 27:
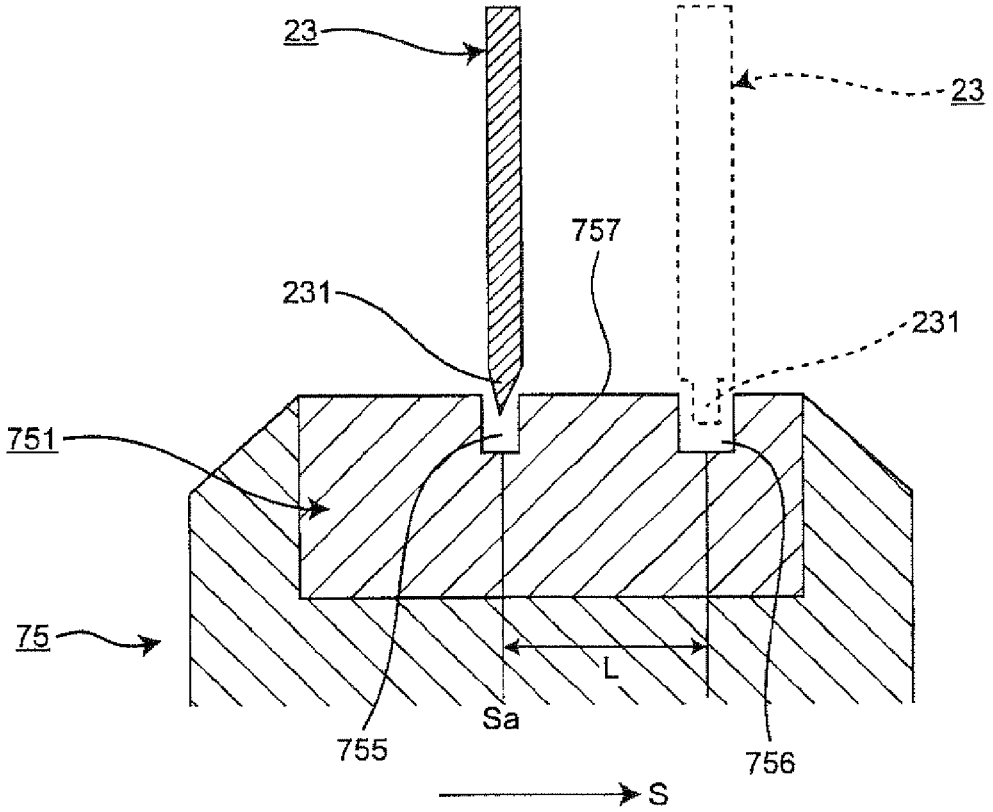
FIG. 27 is a lateral partial cross-sectional view of a receiver of the second embodiment of the present invention.

The processor 71 is capable of moving in the width direction W by the same width direction movement mechanism as that of the first embodiment. The processing blade 23 of the processor 71 rotates along with the movement of the processor 71 in the width direction. The processing blade 23 of the processor 71 approaches and separates from the reception member 751 by swinging the swinging lever in conjunction with the rotation of the cam members following the rotation of the cam rotation shaft 62. FIG. 27 is a lateral partial cross-sectional view of the receiver 75. To the top face of the receiver 75, the reception member 751 extending in the width direction W is fixed. As in the first embodiment, the first to third reception portions 755, 756 and 757 are formed on the reception member 751.

The controller 6 has a conveyance adjuster that adjusts, based on the detected kind of the processing blade 23, the conveyance mechanism and the driver thereof so that the position of the blade edge 231 of the processing blade 23 coincides with the processing position of the paper sheet in the set processing information. For example, in a case where the set processing information represents performing perforation processing in a position in a conveyance direction Sa and a perforating blade is attached to the processor 71 as the processing blade 23, when the processing blade 23 is changed to a creasing blade in order to perform folding processing in the same position in the conveyance direction Sa instead of perforation processing, the conveyance adjuster operates as follows: When the perforating blade is changed to the creasing blade, as in the case of FIG. 5 and as shown in FIG. 27, the position of the blade edge 231 is shifted toward the downstream side in the conveyance direction by the distance L. Therefore, if the processing machine 7X is operated under that condition, folding processing is performed in a position shifted by the distance L from the position in the conveyance direction Sa. Therefore, the conveyance adjuster additionally moves the paper sheet in the conveyance direction by the distance L to thereby adjust the conveyance mechanism and the driving portion thereof so that the blade edge 231 of the creasing blade is situated in the position in the conveyance direction Sa.

The remaining structures are the same as those of the first embodiment, or the structures of the first embodiment may be applied analogically. For example, the sensor 44 for reading the identification information of the processing blade 23 is provided on the processing machine itself so as to be opposed to the side surface of the processing blade 23 instead of being provided on the left and right side plates 512 and 513.

In the present embodiment, the processing blade 23 is changeable in the processing machine 7X as in the first embodiment.

According to the present embodiment, similar effects to those of the first embodiment are also delivered.

Third Embodiment

While the processing unit of the second embodiment performs "lateral processing" by the processing blade 23 which is a rotary blade, the processing unit of the present embodiment performs "lateral processing" by a processing blade which is a guillotine blade.

Figure 28:
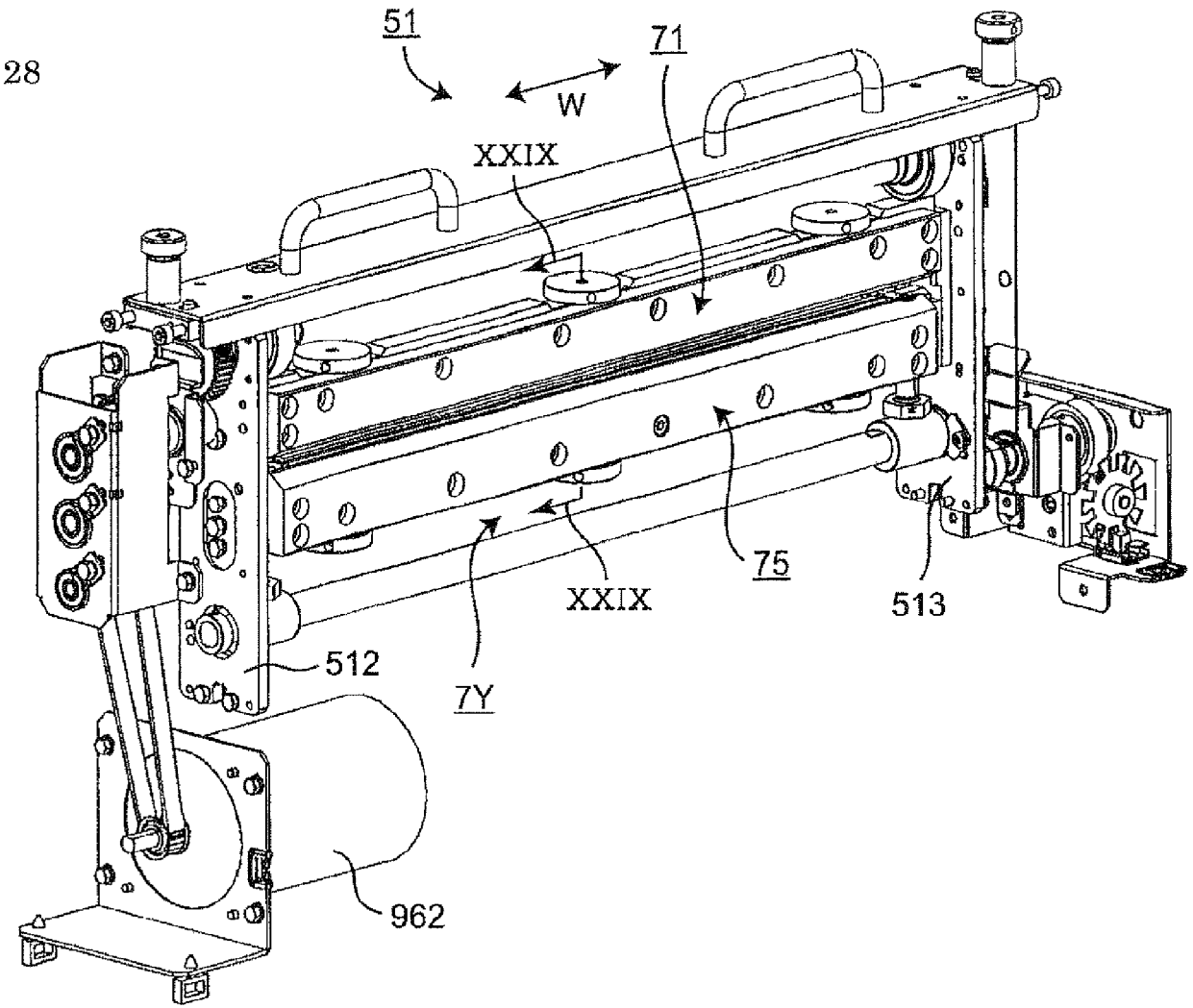
FIG. 28 is a perspective view of the processing unit of a third embodiment of the present invention viewed from the upstream side.

FIG. 28 is a perspective view of the processing unit 51 of the present embodiment viewed from the upstream side. This processing unit 7Y includes a linear processor 71 extending in the width direction W and a linear receiver 75 extending in the width direction W.

Figure 29:
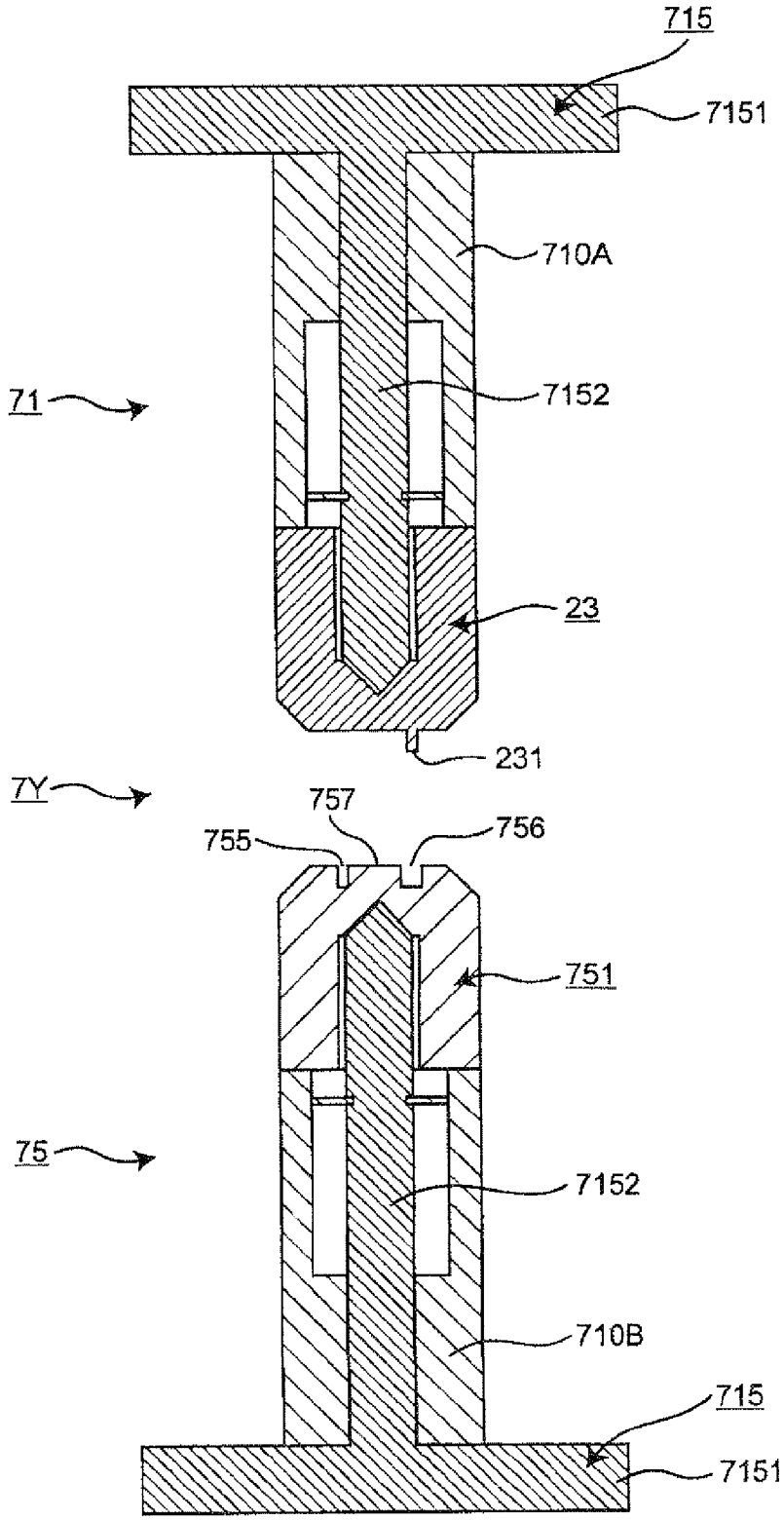
FIG. 29 is a cross-sectional view taken along XXIX-XXIX of FIG. 28.

FIG. 29 is a cross-sectional view taken along XXIX-XXIX of FIG. 28. The processor 71 has a processing blade 23 extending in the width direction on the lower edge of an upper body 710A. The processing blade 23 is detachably attached to the upper body 710A by a screw 715. The screw 715 includes a head portion 7151 and a rod 7152, and the rod 7152 is screwed into the processing blade 23 to thereby fix the processing blade 23. The receiver 75 has a reception member 751 extending in the width direction W on the upper edge of the lower body 710B. As in the case of the processing blade 23, the reception member 751 is detachably attached to the lower body 710B by the screw 715. Thus, the processing blade 23 is attachable to the lower body 710B and the reception member 751 is attachable to the upper body 710A. That is, the vertical position relation between the processing blade 23 and the reception member 751 can be reversely interchanged. As in the second embodiment, the first to third reception portions 755, 756 and 757 are formed on the reception member 751.

The processing unit 7Y performs processing by the processor 71 moving downward so that the processing blade 23 engages with the corresponding kind of reception portion of the receiver 75. The vertical movement of the processor 71 is executed by transmitting the rotation of the motor 962 to a cam rotation shaft through a power transmission mechanism (not shown) and vertically moving the upper body 710A by the cam member rotating together with the cam rotation shaft.

The controller 6 has a conveyance adjuster similar to that of the second embodiment.

The remaining structures are the same as those of the first and second embodiments, or the structures of the first and second embodiments may be applied analogically. For example, the sensor 44 for reading the identification information of the processing blade 23 is provided on the processor 71 itself so as to be opposed to the side surface of the processing blade 23 instead of being provided on the left and right side plates 512 and 513. For the identification information of the processing blade 23, one of a similar mode to that of the first embodiment may be formed on the side surface of the processing blade 23 as in the first embodiment.

Figure 30:
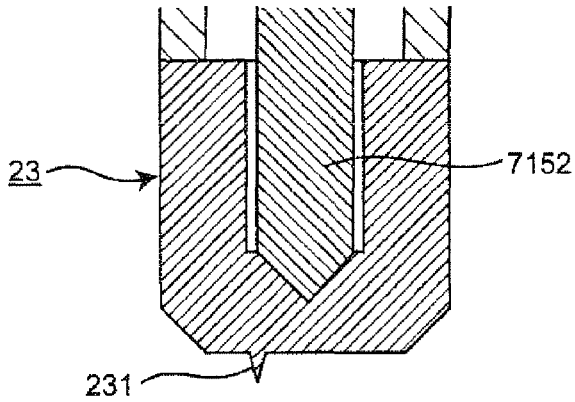
FIG. 30 is a partial cross-sectional view in a case where a perforating blade is attached in the third embodiment.
Figure 31:
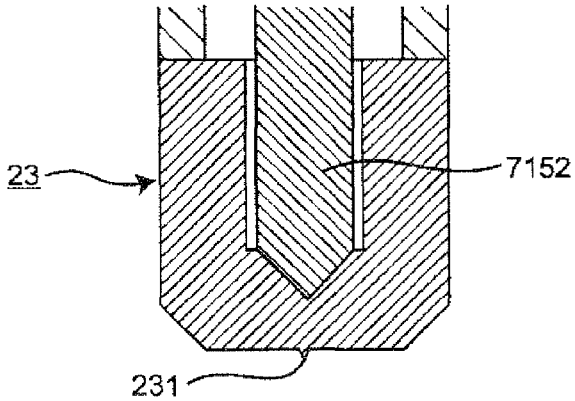
FIG. 31 is a partial cross-sectional view in a case where a half-cutting blade is attached in the third embodiment.
Figure 32:
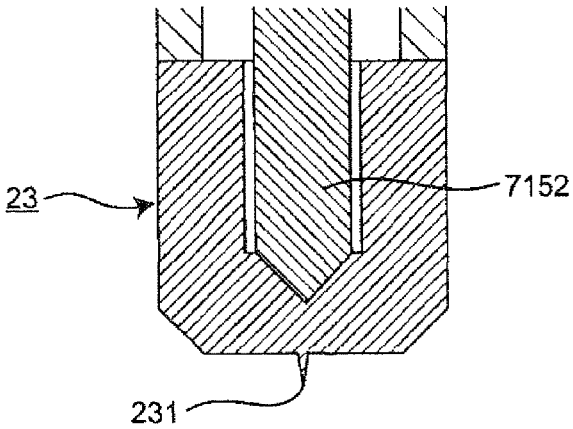
FIG. 32 is a partial cross-sectional view in a case where a micro-perforating blade is attached in the third embodiment.

In the present embodiment, in the processing unit 7Y, the processing blade 23 is changeable as in the first embodiment. That is, while the processing blade 23 which is a creasing blade is attached in FIG. 29, this processing blade 23 can be changed to a perforating blade as shown in FIG. 30, to a half-cutting blade as shown in FIG. 31 or to a micro-perforating blade as shown in FIG. 32.

According to the present embodiment, similar effects to those of the first embodiment are also delivered.

Fourth Embodiment

Figure 33:
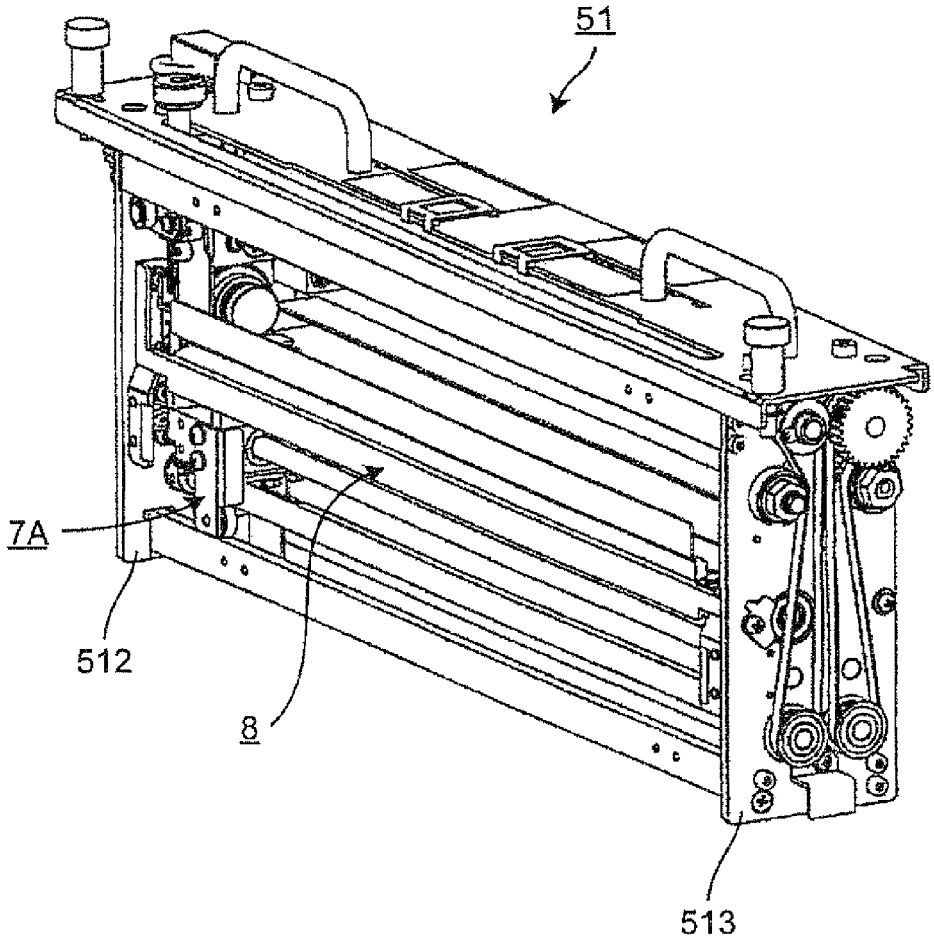
FIG. 33 is a perspective view of the processing unit of a fourth embodiment viewed from the upstream side.
Figure 34:
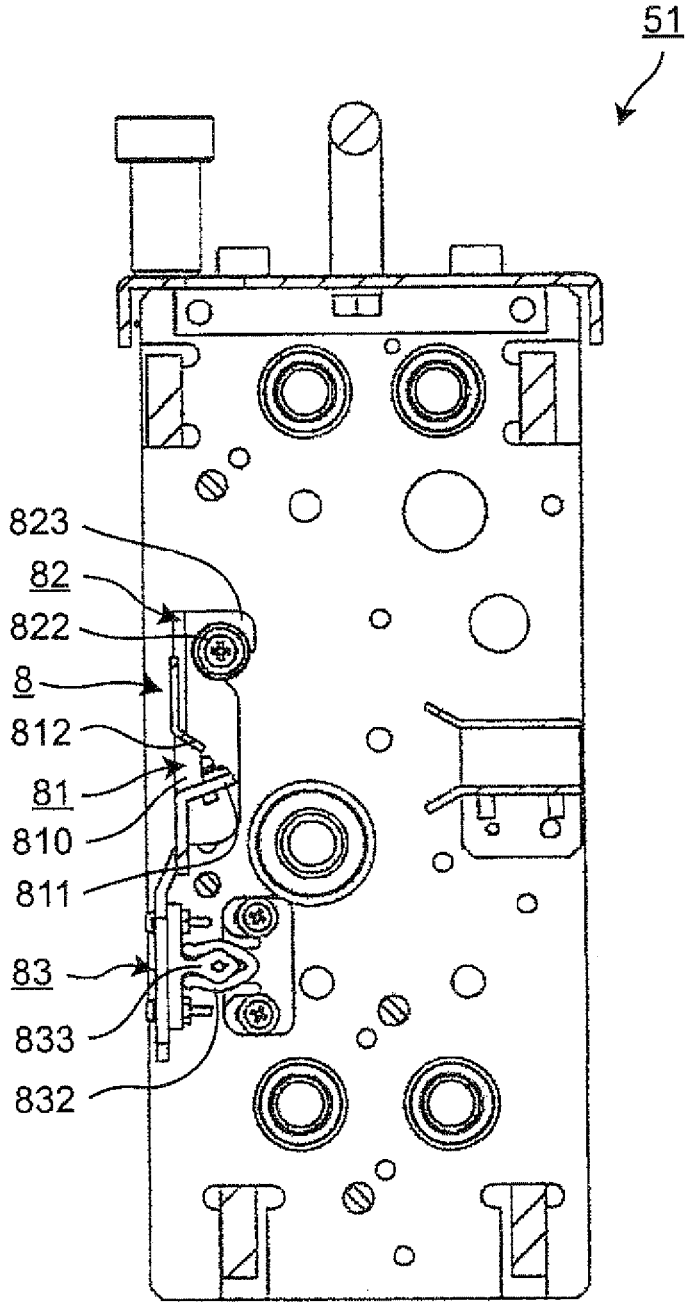
FIG. 34 is a longitudinal cross-sectional view of the processing unit of FIG. 33.
Figure 36:
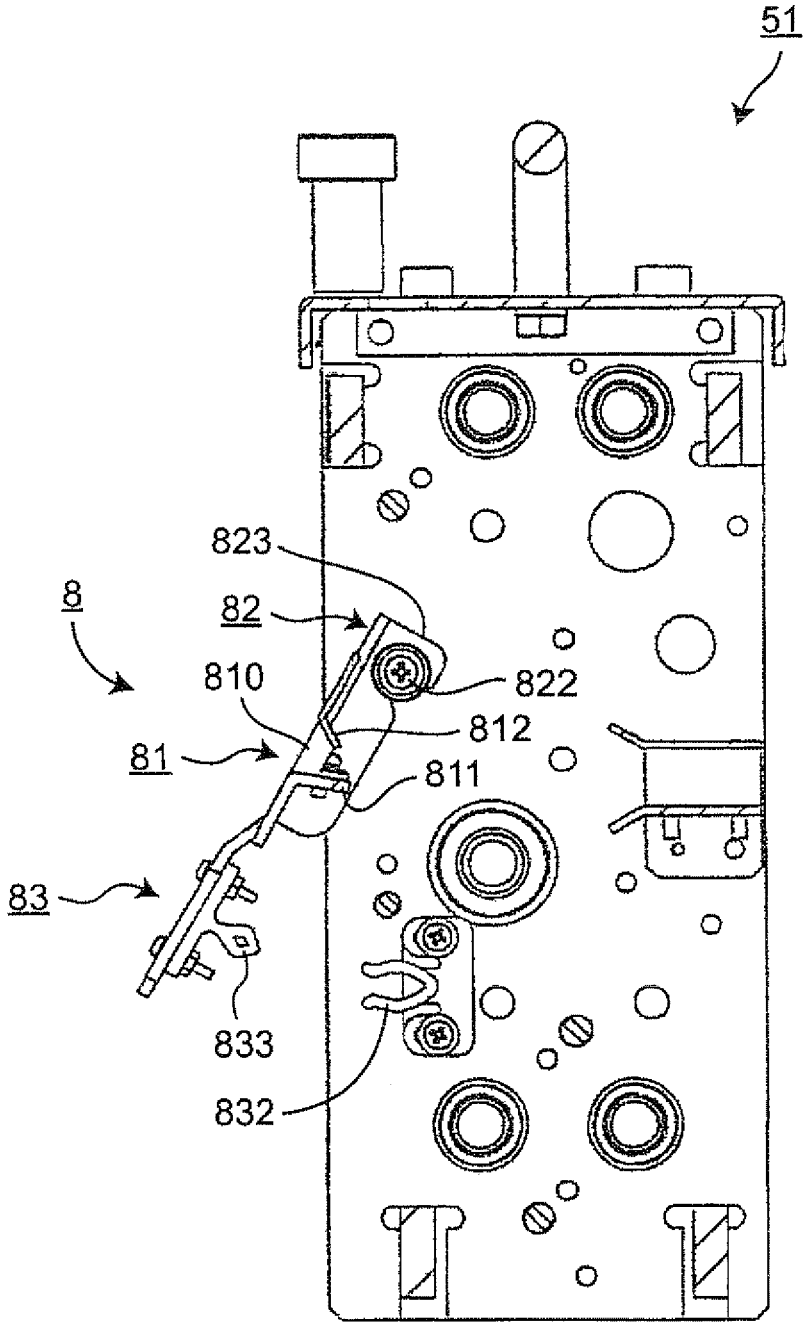
FIG. 36 is a longitudinal cross-sectional view of the processing unit of FIG. 35.
Figure 38:
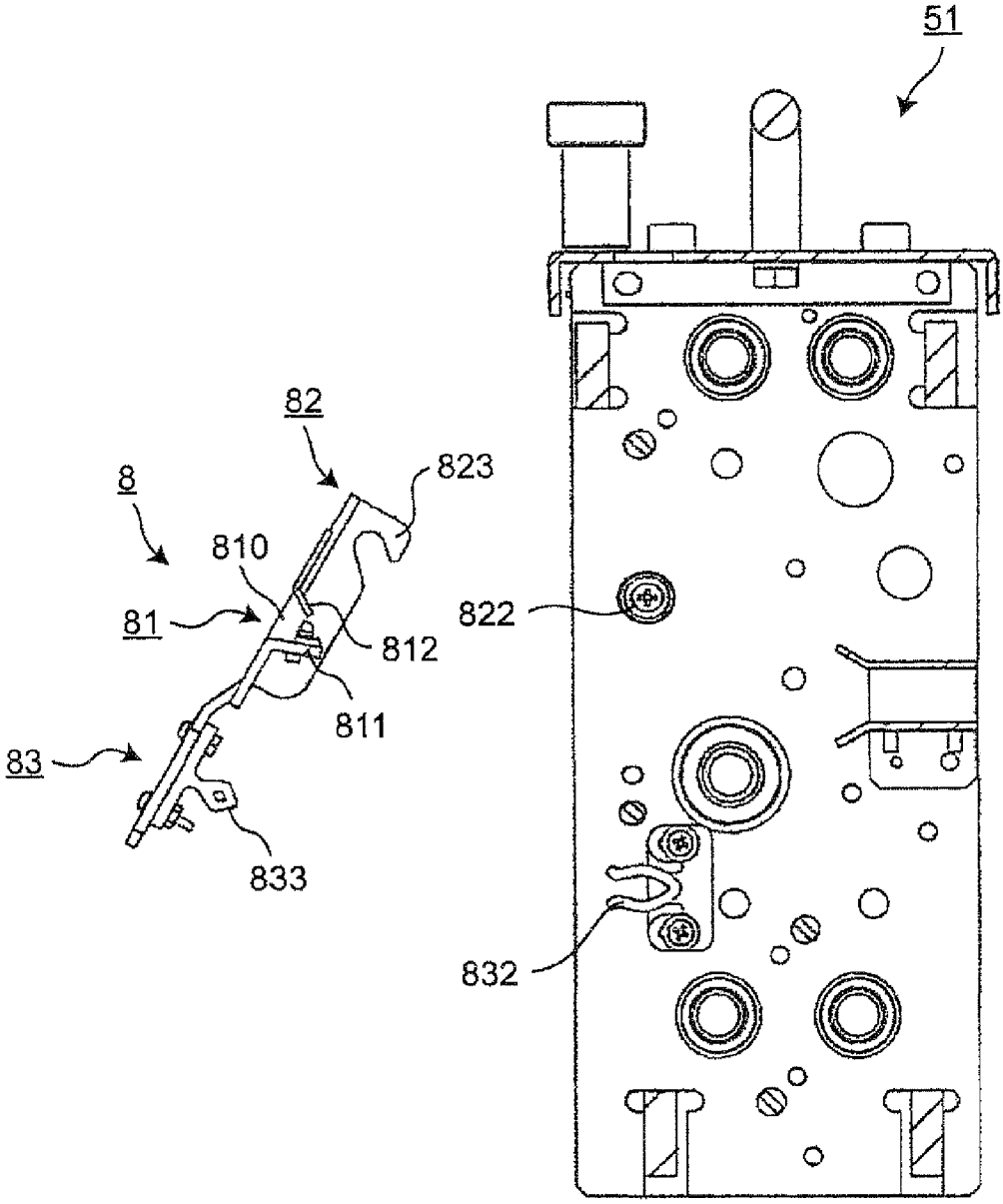
FIG. 38 is a longitudinal cross-sectional view of the processing unit of FIG. 37.

The processing unit of the present embodiment has, on the upstream side, a guide member that guides the conveyed paper sheet to the processing machine. FIG. 33 is a perspective view of the processing unit 51 viewed from the upstream side. FIG. 34 is a longitudinal cross-sectional view of the processing unit 51 of FIG. 33. In the longitudinal cross-sectional views of the processing unit 51 shown in FIGS. 34, 36 and 38, illustration of the processing machine 7A is omitted for convenience of explanation. The guide member 8 includes a guide portion 81, a support portion 82 and an engagement portion 83. The guide portion 81 has a lower piece 811 and an upper piece 812 extending in the width direction W, and a clearance 810 for passing the paper sheet is formed therebetween. The lower piece 811 extends from the upstream side toward the downstream side so as to slightly incline upward, and the upper piece 812 extends from the upstream side toward the downstream side so as to slightly incline downward. The clearance 810 therebetween gradually becomes narrower from the upstream side toward the downstream side.

The guide member 8 is structured so that it can be easily attached to and detached from the processing unit 51, that is, to the processing machine by hand without the use of a tool. This is realized by the support portion 82 and the engagement portion 83. The support portion 82 has, as shown in FIGS. 35 to 38, a pin 822 provided on the inner surfaces of the side plates 512 and 513 and a hook portion 823 structured so that it can be hooked on the pin 822 so as to be rotatable and detachably attachable from above. The engagement portion 83 has a sandwiching portion 832 provided on the inner surfaces of the side plates 512 and 513 and a convex portion 833 that can be inserted into and taken out from the sandwiching portion 832. FIGS. 33 and 34 show a condition where the guide member 8 is attached to the processing unit 51 by hooking the hook portion 823 on the pin 822 and inserting the convex portion 833 into the sandwiching portion 832.

Figure 35:
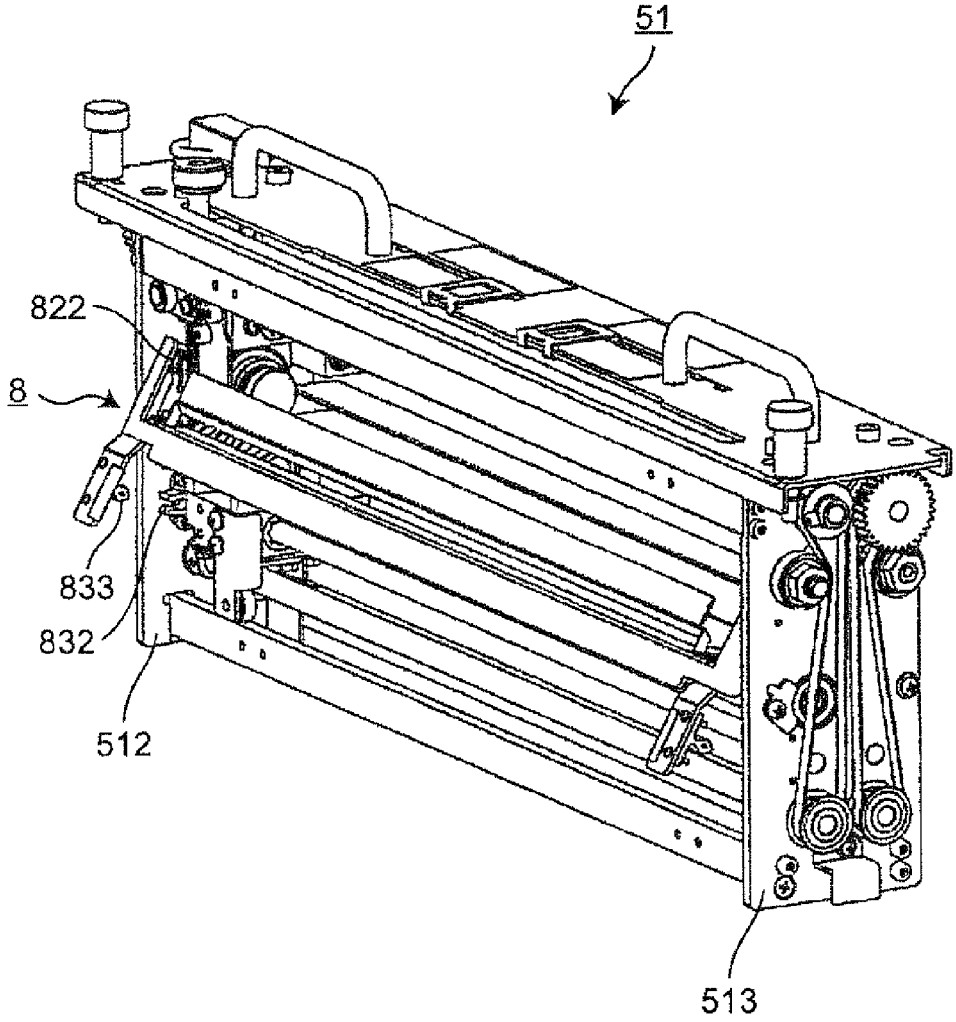
FIG. 35 is a perspective view showing the process of detaching a guide member of FIG. 33.
Figure 37:
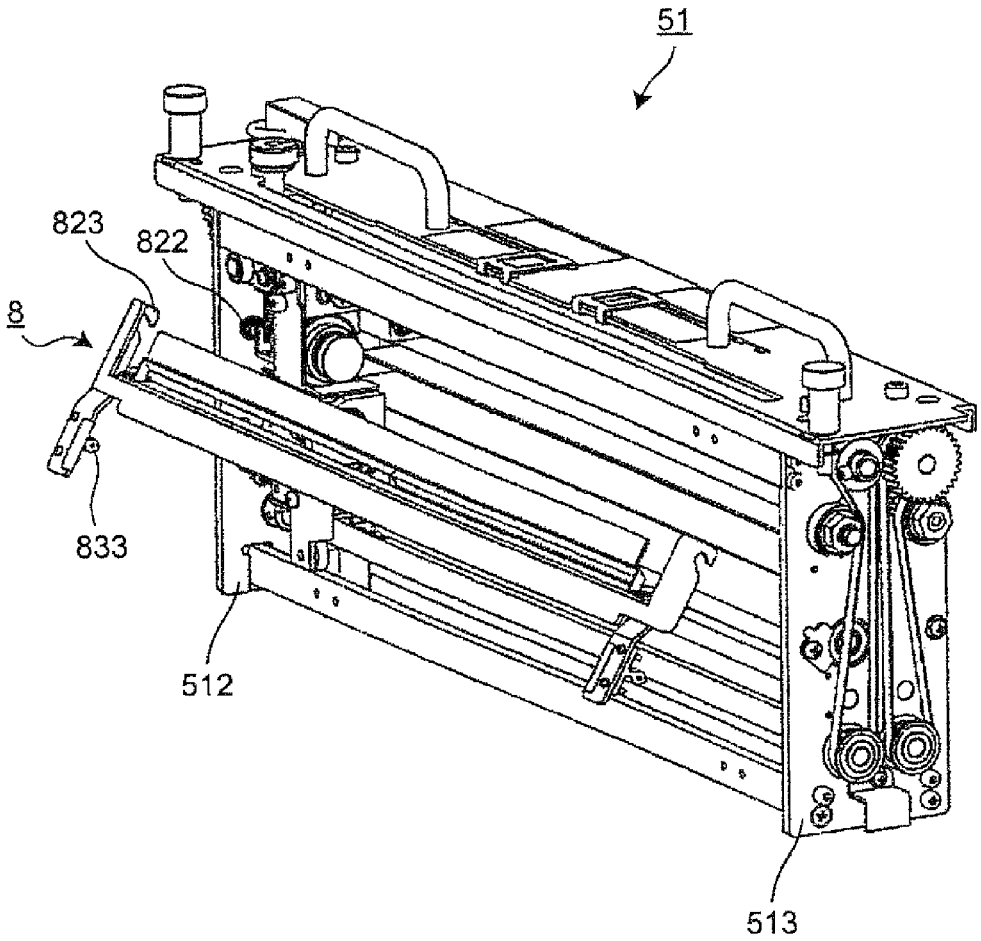
FIG. 37 is a perspective view showing a condition where the guide member of FIG. 33 has been detached.

When the guide member 8 is detached from the processing unit 51, as shown in FIG. 35 and FIG. 36 which is a longitudinal cross-sectional view of the processing unit 51 of FIG. 35, first, the convex portion 833 is taken out from the sandwiching portion 832, and the guide member 8 is rotated on the pin 822 toward the upstream side. Then, as shown in FIG. 37 and FIG. 38 which is a longitudinal cross-sectional view of the processing unit 51 of FIG. 37, the hook portion 823 is detached from the pin 822 by moving it upward.

According to the present embodiment, since the paper sheet can be guided to the processing machine by the guide member 8, the paper sheet processing at the processing machine can be executed with stability.

Further, according to the present embodiment, since the guide member 8 is detachable from the processing unit 51, space can be secured on the upstream side of the processing machine. Consequently, the processing blade of the processing machine can be smoothly changed.

Other Embodiments (1) The different kinds of processing blades mean processing blades including both of (a) a case where the forms are different and (b) a case where the sizes and/or configurations are different although the forms are the same. Examples of the case (a) include a perforating blade, a creasing blade, a half-cutting blade and a micro-perforating blade. Examples of the case (b) include, in the case of the creasing blade, a creasing blade the thickness of the blade edge of which is different so that the width of the formed folding pattern is different and/or a creasing blade the blade edge of which is angular or circular so that the configuration of the formed folding pattern is different. Therefore, while in the above-described embodiments, processing blades of different processing forms such as a perforating blade, a creasing blade, a half-cutting blade and a micro-perforating blade are adopted as the different kinds of processing blades, the present invention may adopt processing blades having different sizes and/or configurations although having the same processing form.

(2) While a case where the processing unit 51 of the first embodiment has the guide member 8 is described in the fourth embodiment, the processing units of the second and third embodiments may have the guide member 8, and in that case, similar effects to those of the fourth embodiment are also delivered.

(3) While the processing blade has the identification information in the above-described embodiments, the present invention may use a processing blade having no identification information. In that case, the operator can input the kind of the processing blade attached to the processing machine with the setting portion 601 of the operation panel 60, and the movement adjuster of the controller 6 adjusts the width direction movement mechanism so that the position of the blade edge of the processing blade coincides with the processing position of the paper sheet in the set processing information based on the inputted kind of the processing blade or the conveyance adjuster adjusts the conveyance mechanism so that the processing position of the paper sheet in the set processing information coincides with the position of the blade edge of the processing blade based on the inputted kind of the processing blade.

(4) A structure may be adopted in which the processing information and the kind of the processing blade can be inputted from other than the setting portion 601 of the operation panel 60. For example, a structure may be adopted in which they can be inputted from an external terminal connected by cable or wirelessly.

As described above, the present invention where the kind of the processing on the paper sheet can be easily and inexpensively changed to perform processing is extremely useful in industry.

The invention claimed is:

1. A processing machine comprising:

a processor having a processing blade; and a receiver having a reception member;

wherein the processing blade is one processing blade selected from a blade group consisting of at least two processing blades, wherein the at least two processing blades are different from each other, and is attached to the processor so as to be changeable to another processing blade of the blade group, wherein each of the processing blades is configured to perform a different process on a sheet of paper situated between the processor and the receiver; and the reception member having at least two different reception portions, wherein each of the reception portions is configured to engage with a respective one of the processing blades.

2. The processing machine according to claim 1, wherein the processing blade is screwed to the processor.

3. The processing machine according to claim 2, wherein the processing blade is a rotary blade.

4. The processing machine according to claim 2, wherein the processing blade is a guillotine blade.

5. The processing machine according to claim 1, wherein the processing blade is a rotary blade.

6. The processing machine according to claim 5, wherein the processing blade has a boss portion, and is positioned by a thickness of the boss portion that is set according to the selected processing blade.

7. The processing machine according to claim 1, wherein the processing blade is a guillotine blade.

8. The processing machine according to claim 7, wherein the processing blade and the reception member are interchangeable with each other.

9. The processing machine according to claim 1, wherein the blade group consists of at least two of a cutting blade, a perforating blade, a creasing blade, a half-cutting blade and a micro-perforating blade.

10. The processing machine according to claim 1, wherein the number of reception portions formed on the reception member is smaller than the number of processing blades of the blade group.

11. The processing machine according to claim 1, wherein the at least two different reception portions are located at different positions on the reception member.

12. A paper sheet processing device having the processing machine according to claim 1 and processing a paper sheet while conveying the paper sheet, wherein a conveyance mechanism that conveys the paper sheet and a width direction movement mechanism that moves the processing machine in a direction orthogonal to a conveyance direction of the paper sheet are provided, the processing blade is a rotary blade that performs processing along the conveyance direction of the paper sheet, a setting portion for setting processing information of the paper sheet and inputting the processing blade attached to the processing machine and a controller that controls an operation of the processing machine based on the set processing information are provided, and the controller has a movement adjuster that adjusts, based on the inputted processing blade, the width direction movement mechanism so that a position of the blade edge of the processing blade coincides with a processing position of the paper sheet in the set processing information.

13. A paper sheet processing device having the processing machine according to claim 1 and processing a paper sheet while conveying the paper sheet, wherein a conveyance mechanism that conveys the paper sheet is provided, the processing blade is a rotary blade or a guillotine blade that performs processing along a direction orthogonal to a conveyance direction of the paper sheet, a setting portion for setting processing information of the paper sheet and inputting the processing blade attached to the processing machine and a controller that controls an operation of the processing machine based on the set processing information are provided, and the controller has a conveyance adjuster that adjusts, based on the inputted processing blade, the conveyance mechanism so that a processing position of the paper sheet in the set processing information coincides with a position of the blade edge of the processing blade.

14. A paper sheet processing device having the processing machine according to claim 1 and processing a paper sheet while conveying the paper sheet, wherein a conveyance mechanism that conveys the paper sheet and a width direction movement mechanism that moves the processing machine in a direction orthogonal to a conveyance direction of the paper sheet are provided, the processing blade is a rotary blade that performs processing along the conveyance direction of the paper sheet, the processing blade each has identification information for identifying the processing blade, a setting portion for setting processing information of the paper sheet, a controller that controls an operation of the processing machine based on the set processing information, and a reader that reads the identification information of the processing blade attached to the processing machine are provided, and the controller has a detector that detects the processing blade based on the identification information read by the reader and a movement adjuster that adjusts, based on the detected processing blade, the width direction movement mechanism so that a position of the blade edge of the processing blade coincides with a processing position of the paper sheet in the set processing information.

15. The paper sheet processing device according to claim 14, wherein the controller further has a stopper that compares the detected processing blade and the processing blade required for executing the set processing information with each other and when they do not coincide with each other, stops initiation of operation of the processing machine.

16. The paper sheet processing device according to claim 14, further comprising a display portion that displays the detected kind of the processing blade.

17. The paper sheet processing device according to claim 14, wherein the identification information of the processing blade is a disposition pattern of a plurality of through holes formed in the processing blade, and the reader has a sensor that detects the disposition pattern of the through holes.

18. The paper sheet processing device according to claim 14, wherein a guide member that guides the paper sheet to the processing machines is provided so as to be detachably attachable to the processing machines.

19. A paper sheet processing device having the processing machine according to claim 1 and processing a paper sheet while conveying the paper sheet, wherein a conveyance mechanism that conveys the paper sheet is provided, the processing blade is a rotary blade or a guillotine blade that performs processing along a direction orthogonal to a conveyance direction of the paper sheet, the processing blade each has identification information for identifying the processing blade, a setting portion for setting processing information of the paper sheet, a controller that controls an operation of the processing machine based on the set processing information, and a reader that reads the identification information of the processing blade attached to the processing machine are provided, and the controller has a detector that detects the processing blade based on the identification information read by the reader and a conveyance adjuster that adjusts, based on the detected processing blade, the conveyance mechanism so that a processing position of the paper sheet in the set processing information coincides with a position of the blade edge of the processing blade.

20. The paper sheet processing device according to claim 19, wherein the controller further has a stopper that compares the detected processing blade and the processing blade required for executing the set processing information with each other and when they do not coincide with each other, stops initiation of operation of the processing machine.

21. The paper sheet processing device according to claim 19, further comprising a display portion that displays the detected processing blade.

22. A processing machine comprising:

a processor; and a receiver having a reception member;

a first processing blade;

a second processing blade; and an attachment device on the processor that is configured to selectively attach and detach each of the first and second processing blades to the processor;

wherein each of the processing blades is configured to perform a different process on a sheet of paper situated between the processor and the receiver;

the reception member having at least two different reception portions, wherein each of the reception portions is configured to engage with a respective one of the processing blades so that one reception member can be used with each of the different processing blades.

* * * * *